US010927615B2

(12) United States Patent
De Mul et al.

(10) Patent No.: US 10,927,615 B2
(45) Date of Patent: Feb. 23, 2021

(54) DRILLING RIG WITH A TOP DRIVE SYSTEM OPERABLE IN A WELLBORE DRILLING MODE, TRIPPING MODE, AND BYPASSING MODE

(71) Applicant: ITREC B.V., Schiedam (NL)

(72) Inventors: Arthur Alexander De Mul, Schiedam (NL); Ronny Lambertus Waltherus Nouwens, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 16/500,916

(22) PCT Filed: Apr. 6, 2018

(86) PCT No.: PCT/NL2018/050212
§ 371 (c)(1),
(2) Date: Oct. 4, 2019

(87) PCT Pub. No.: WO2018/186745
PCT Pub. Date: Oct. 11, 2018

(65) Prior Publication Data

US 2020/0115969 A1 Apr. 16, 2020

(30) Foreign Application Priority Data

Apr. 6, 2017 (NL) ..... 2018663

(51) Int. Cl.
*E21B 19/07* (2006.01)
*E21B 19/14* (2006.01)
(Continued)

(52) U.S. Cl.
CPC ..... *E21B 19/07* (2013.01); *E21B 19/14* (2013.01); *E21B 19/16* (2013.01); *E21B 19/20* (2013.01)

(58) Field of Classification Search
CPC ..... E21B 19/07; E21B 19/14; E21B 19/16; E21B 19/20
See application file for complete search history.

(56) References Cited

U.S. PATENT DOCUMENTS

2013/0302114 A1* 11/2013 Reddy ..... E21B 19/083 414/22.55
2016/0090786 A1* 3/2016 Roodenburg ..... E21B 15/00 175/57
2018/0238127 A1* 8/2018 Berry ..... E21B 19/06

FOREIGN PATENT DOCUMENTS

WO WO 2006/038790 A1 4/2006
WO WO 2013/109147 A2 7/2013
(Continued)

OTHER PUBLICATIONS

International Search Report, issued in PCT/NL2018/050212, dated Jun. 25, 2018.
(Continued)

*Primary Examiner* — Matthew R Buck
(74) *Attorney, Agent, or Firm* — Birch, Stewart, Kolasch & Birch, LLP

(57) ABSTRACT

A drill rig includes a drilling tower, a drill floor with a well center, a slip device arranged at the well center, a tubulars connection makeup and breaking device, and a top drive system. The top drive system includes a traveling carriage that is vertically mobile along vertical rails of the drilling tower by means of a vertical motion drive. The system also includes a top drive unit supported by the carriage and including a top drive motor and a rotary torque output member. The system further includes a tripping operation elevator adapted to be engaged with the drill string in order to perform tripping operations. The top drive unit and the tripping operation elevator are each mobile relative to the traveling carriage, and the top drive system is provided with
(Continued)

actuators adapted to cause the relative motion of the top drive unit and of the tripping operation elevator so as to provide a drilling mode, a tripping mode and bypassing mode.

10 Claims, 21 Drawing Sheets

(51) Int. Cl.
*E21B 19/16* (2006.01)
*E21B 19/20* (2006.01)

(56) References Cited

FOREIGN PATENT DOCUMENTS

| | | | |
|---|---|---|---|
| WO | WO 2013/109148 | A2 | 7/2013 |
| WO | WO 2013/133698 | A2 | 9/2013 |
| WO | WO 2014/133389 | A2 | 9/2014 |
| WO | WO 2014/178712 | A1 | 11/2014 |
| WO | WO 2016/204608 | A1 | 12/2016 |

OTHER PUBLICATIONS

Written Opinion of the International Searching Authority, issued in PCT/NL2018/050212, dated Jun. 25, 2018.

* cited by examiner

DRILLING RIG WITH A TOP DRIVE SYSTEM OPERABLE IN A WELLBORE DRILLING MODE, TRIPPING MODE, AND BYPASSING MODE

FIELD OF THE INVENTION

The invention relates to the field of drilling rigs. For example the invention is applicable to mobile modular drilling rigs that are composed of modules that can be easily assembled and for example transported by road vehicles from one drilling location to the next.

BACKGROUND OF THE INVENTION

Examples of mobile modular drilling rigs are presented in WO2006/038790, WO2013/133698, WO2013/109147, and WO2014/178712 of the present applicant.

The drilling rig comprises a drilling tower and a drill floor with a well center. The well center of the drill floor is in practice aligned with the wellbore or borehole, e.g. a wellbore to a hydrocarbon reservoir or for a geothermal well. In a land rig version the drill floor may be held at an elevated level above the ground, e.g. allowing for placement of a Blow Out Preventer underneath the drill floor. The rig may also be employed in an offshore environment, e.g. on a cantilever of a jack-up platform or on a jacket foundation, possibly with a subsea riser leading to the subsea wellbore or for use in a riserless wellbore operation.

In known embodiments a slip device is arranged at the well center and is adapted to suspend a drilling tubulars string in the wellbore. For example a remote controlled mechanized slip device is provided, allowing controlled operation thereof from an operator cabin.

In known embodiments the drilling rig comprises a tubulars connection makeup and breaking device near the well center, known in the art e.g. as an iron roughneck machine or mechanized tong device. Commonly such a device allows for mechanized connecting and disconnecting of threaded connectors at the ends of the drilling tubulars and/or of socket joints. For example a remote controlled mechanized tubulars connection makeup and breaking device is provided, allowing controlled operation thereof from an operator cabin. In known embodiment the drilling rig comprises a fingerboard device that is adapted to store drilling tubulars stands.

In known embodiments the drilling rig comprises a top drive system and a vertical motion drive that is adapted to cause vertical motion of the top drive system relative to the drilling tower in order to perform drilling and tripping operations.

A known top drive system comprises a traveling carriage that is vertically mobile along one or more vertical rails of the drilling tower by means of the vertical motion drive. The one or more vertical rails are statically mounted and are parallel to a vertical firing line that extends through the well center.

The traveling carriage supports a top drive unit which comprises a top drive motor and a rotary torque output member, e.g. a rotary stem, that is adapted to be engaged, e.g. threaded, with a top end of a drilling tubulars string extending in the firing line through the well center to impart torque to said drilling tubulars string in order to perform drilling operations.

In the field, a known operation is tripping of the drill string, e.g. when the drill bit has worn out and needs to be replaced or serviced. This involves tripping out, wherein the drill string is lifted so that a stand of multiple drilling tubulars extends above the drill floor. For example it is known to pull triple length stands, having a total length of about 90 ft. The drill string is then suspended in the wellbore by means of the slip device and the raised tubulars stand is disconnected by means of the tubulars connection makeup and breaking device near the well center. For example the connection makeup and breaking device is held by a mobile arm, e.g. the arm being mounted on a support on the drill floor remote from the well center. After breaking the connection, the tubulars stand is then placed in a slot of the fingerboard. This tripping out process is continued until the drill bit has reached the drill floor. After replacement or servicing of the drill bit, the drill string is tripped back into the borehole again. Other reasons for tripping a drill string are for example the need to service of replace other downhole tools, e.g. like a mud motor, a MWD unit (measurement while drilling), etc.

It is known to make use of a remote controlled mechanized tubulars racking device to move the tubulars stands between the firing line and the fingerboard, allowing controlled operation thereof from an operator cabin.

Tripping is commonly perceived as a time consuming and thereby expensive process. It is noted that tripping may also involve other tubular strings than the drill pipe string, e.g. a casing string composed of interconnected casing tubulars.

In WO2016/204608 of the same applicant, it is proposed to configure the top drive system such that, in tripping mode, an unobstructed zone is present vertically above the tripping operation elevator allowing to the top drive system to be lowered along a drilling tubulars stand in the firing line above the well center, at least so that the top drive system is below the top end thereof, e.g. allowing lowering till near the well center on the drill floor, whilst the drilling tubulars stand is disconnected by means of the tubulars connection makeup and breaking device. It is further proposed that the top drive system is embodied such that, in the tripping mode and with the top drive system lowered at least below the top end of the drilling tubulars stand, the drilling tubulars stand is removable from the firing line, primarily in lateral direction to allow for placement of the drilling tubulars stand in the fingerboard device.

An advantage of the previously proposed top drive system is that it allows to combine the known and advantageous use of a top drive system for a drilling operation, instead of using a rotary table drive system to impart torque to the drill string, with a fast tripping of the drilling tubulars string and also with a fast and efficient switchover from a drilling operation to a tripping operation and vice versa.

However, although the prior art solution results in a significant reduction of time involved in a tripping operation, the obtained reduction is not satisfactory.

OBJECT OF THE INVENTION

Hence, it is an object of the present invention to provide an improved drilling rig, e.g. in view of the desire to reduce time involved in a tripping operation.

SUMMARY OF THE INVENTION

This object is achieved by providing a drilling rig adapted to perform drilling and/or other wellbore related activities, the drilling rig comprising:

- a drilling tower;
- a drill floor with a well center positionable above a wellbore;

a slip device adapted to suspend a drilling tubulars string in the wellbore;

a tubulars connection makeup and breaking device near the well center;

a top drive system;

a vertical motion drive adapted to cause a vertical motion of the top drive system relative to the drilling tower in order to perform drilling and tripping operations;

a fingerboard device adapted to store drilling tubular stands, wherein the drilling tower is provided with one or more vertical rails parallel to a vertical firing line that extends through the well center, wherein the drilling rig further comprises a tubulars racking device comprising one or more mobile tubulars gripper assemblies with one or more grippers adapted to grip a drilling tubular or drilling tubulars stand and to move the drilling tubular or drilling tubulars stand between the fingerboard device and the firing line, wherein the top drive system comprises:

a traveling carriage that is vertically mobile along said one or more vertical rails of the drilling tower by means of said vertical motion drive, a top drive unit supported by said traveling carriage and comprising a top drive motor and a rotary torque output member that is adapted to be engaged with a top end of a drilling tubulars string extending in the firing line through the well center to impart torque to said drilling tubulars string in order to perform drilling or other wellbore related operations, wherein the top drive system comprises a tripping operation elevator that is adapted to be engaged with a drilling tubulars string or drilling tubulars stand in order to perform tripping operations, wherein the top drive unit and the tripping operation elevator are mobile relative to the carriage, and wherein the top drive system is provided with an actuator assembly adapted to cause said relative motion of the top drive unit and of the tripping operation elevator so as to provide:

a wellbore drilling mode;

a tripping mode; and a bypassing mode, wherein the top drive unit is moveable by said actuator assembly between an operative position, in which the rotary torque output member is aligned with the firing line, and a retracted position, wherein the tripping operation elevator is moveable by said actuator assembly between an operative position, in which the tripping operation elevator is aligned with the firing line, and a non-operative position away from the firing line, wherein, in the wellbore drilling mode, the top drive unit is positioned in the operative position and the tripping operation elevator is positioned in a non-operative position away from the firing line, wherein, in the tripping mode, the top drive unit is positioned in the retracted position and the tripping operation elevator is positioned in the operative position, such that an unobstructed zone is present vertically above the tripping operation elevator allowing the top drive system to be lowered along a drilling tubulars stand held by the slip device in the firing line above the well center, at least until the top drive system has passed below a top end of said drilling tubulars stand, wherein the top drive system is embodied such that when the top drive system is lowered at least below the top end of said drilling tubulars stand, said drilling tubulars stand is removable from the firing line, primarily in lateral direction by means of the tubulars racking device, to allow for placement of said drilling tubulars stand in said fingerboard device, wherein, in said bypassing mode, the top drive unit is positioned in the retracted position and the tripping operation elevator is positioned in a retracted position away from the firing line in a direction corresponding to the direction of retraction of the top drive unit, and wherein, in said bypassing mode, both the top drive unit and the tripping operation elevator are cleared from the firing line to such an extent that, with the tubulars racking device engaging on a drilling tubulars stand held by the slip device in the firing line above the well center, the top drive system is able to pass the location where the tubulars racking device engages on said drilling tubulars stand.

An advantage of the drilling rig according to the invention is that both the top drive unit and the tripping operation elevator can be positioned away from the firing line to such an extent that the top drive system is able to pass the tubulars racking device engaging on the drilling tubulars stand held by the slip device in the firing line above the well center. As a result, the top drive system can already be lowered past the tubulars racking device after a tripping operation while the drilling tubulars stand is disconnected by means of the tubulars connection makeup and breaking device, but can also already be raised past the tubulars racking device after a drilling operation while a new drilling tubulars stand is connected by means of the tubulars connection makeup and breaking device. Hence, an additional time reduction is possible during a tripping operation, but also during a drilling operation.

In a preferred embodiment, all equipment involved in the tripping and/or drilling process of this drilling rig is mechanized by provision of appropriate drive devices and control devices, which devices are preferably remote controlled from an operator cabin, allowing to perform the tripping operation and/or drilling operation without any crew members near the well center or at least with minimal human presence near the well center during the tripping and/or drilling.

Preferably, all equipment involved in the tripping and/or drilling operation as discussed herein is connected to a central computerized control unit that is programmed to perform the tripping operation and/or the drilling operation, at least of a major part of the drilling tubulars string, fully automated. It is envisaged that in such fully automated tripping and/or drilling sequence one or more operators in an operator cabin merely serve to supervise the process and respond in case of anomalies. In a semi-automated sequence some commands may be given via one or more input devices by the one or more operators, these commands starting parts of the sequence.

In an embodiment, the tripping operation elevator comprises a C-shaped body in top view with a laterally open, e.g. to the front, vertical passage through the elevator body that is dimensioned to allow unhindered vertical passage of the elevator body along the drilling tubulars stand in the firing line when the carriage is moved during tripping, i.e. clearing any enlarged diameter portion(s) thereon formed by one or more connectors in the drilling tubulars stand. The dimensions of the vertical passage and of the open lateral side, e.g. the front, may be chosen to accommodate the largest diameter of the drilling tubulars to be handled by the rig, thereby obviating the need to replace the tripping operation elevator when a different diameter tubular is to be handled, e.g. when handling casing instead of drill pipe joints.

The tripping operation elevator preferably further comprises one or more mobile, e.g. pivotal, locking or tubular engagement members, e.g. on opposite sides of the vertical passage through the elevator body, which in a clearance position thereof allow for passage of the enlarged diameter portion(s) in the tubulars stand e.g. during descent of the carriage in a tripping operation and in a locked position thereof engage underneath a shoulder formed by such an enlarged diameter portion, e.g. connector, e.g. threaded connector, of the tubular in order to allow the tubular, more in particular the tubulars string, to be lifted.

For example, two mobile locking members are provided on the tripping operation elevator, each locking member pivotal about a horizontal axis, e.g. each locking member having a tubular facing end with a semi-circular recess adapted to the diameter of the tubular to be handled. For example it is envisaged that the locking members are adapted to the diameter of the tubular to be handled, and that only the locking members are exchanged if another tubular diameter is to be handled.

For example, an actuator, e.g. a hydraulic cylinder, is provided for each locking member, e.g. allowing for remote control of the locking member.

For example, the tripping elevator is provided with a C-shaped horizontal cross section funnel at its lower end facilitating the sliding of the elevator along the tubulars stand as well as the passing of the elevator of the stick up end of a suspended tubulars string.

In an embodiment, the top drive unit and the tripping operation elevator are mechanically linked so as to move in unison when operating the one or more actuators of the actuator assembly in order to switch between the drilling mode and the tripping mode. This allows for a reduction of the number of actuators involved in the switchover and also avoids any opportunity for collision of the top drive unit and the tripping operation elevator, thereby increasing the freedom to design both parts of the top drive system.

In an embodiment, the tripping operation elevator is suspended by one or more links or bails that are each connected at an upper end thereof from a pivotal elevator support arm that is pivotally connected to the traveling carriage about a horizontal pivot axis. This arrangement allows for a robust design of the mechanism that moves this elevator between its tripping mode and drilling mode positions relative to the carriage.

In an embodiment, the carriage is provided with at least one integrated pivotal support arms member, that is pivotally mounted in the carriage about a horizontal pivot axis, and which integrated pivotal support arms member forms a support arm that supports the top drive unit on the traveling carriage, and which integrated pivotal support arms member further forms a tripping elevator support arm from which the tripping operation elevator is suspended, e.g. by one or more links. For example the carriage is provided with a left-hand side integrated pivotal support arms member and a right-hand side pivotal support arms member, e.g. said members being connected to opposite sides of a top drive frame. For example, as preferred, the left-hand and right-hand side integrated pivotal support arms member each extend along the inner side of a respective side wall of a U-shaped horizontal cross-section mast so as to move the top drive unit between an operative position with the rotary output member aligned with the firing line and a retracted position in the tripping mode, wherein the top drive unit is closer to the rear wall of the mast. It will be appreciated that due to the direct mechanical link the tripping operation elevator will also move between the respective positions associated with the drilling mode and the tripping mode. In an embodiment an actuator is arranged to act on an integrated pivotal support arms member, e.g. mounted between the carriage and the integrated pivotal support arms member.

In an embodiment, the vertical motion drive comprises a crown block assembly with sheaves, said crown block assembly being mounted on the tower, and further the vertical motion drive comprises a drawworks with a winch and winch driven cable, wherein the traveling carriage is provided with sheaves. The traveling carriage is suspended from the crown block by said cable passing over said sheaves.

In an alternative design, the vertical motion drive may comprise one or more long stroke hydraulic cylinders, a rack-and-pinion motion drive, or otherwise.

In an embodiment, the sheaves on the traveling carriage are assembled in a left-hand sheave assembly and a right-hand sheave assembly with the unobstructed zone passing or located between these sheave assemblies.

Preferably, a sheave axis of the sheaves on the carriage intersects or passes close to the firing line, so that—in the drilling mode—the rotary output member is vertically below this sheave axis. This allows to create as much as possible a vertical load path between the sheaves on the traveling carriage and the part of the top drive system that is in one of the mentioned modes present in the firing line.

For example, when the tripping elevator is suspended from one or more links it is preferred for said one or more links to be in vertical orientation when in tripping mode, in vertical alignment with the sheaves on the carriage and of the crown block to create a vertical load path for tripping loads. It is noted that during tripping out the vertical loads may be very substantial, not only due to weight of the drilling tubulars string but also due to friction in the wellbore, wellbore curvature and narrow passages, etc. In a preferred embodiment the firing line is located between front posts of a U-shaped horizontal cross section mast, with the carriage travelling between rails fixed to said front posts, so that said vertical tripping loads are in a plane intersecting the front posts.

In an embodiment, the top drive unit is pivotally supported on the traveling carriage about a horizontal pivot axis and, in the drilling mode, the pivot axis is preferably in a vertical plane that encompasses the firing line.

In an embodiment, the tripping operation elevator is suspended by one or more links that are each connected at an upper end thereof to a pivotal elevator support arm that is pivotally connected to the traveling carriage about a horizontal pivot axis and, in the tripping mode, the links of the tripping operation elevator are in a vertical plane. Preferably in an embodiment this vertical plane extends through, or is close to, a plane through the sheaves of the crown block and the sheaves on the traveling carriage in order to create as much as possible a vertical load path.

In an embodiment, the top drive unit comprises a top drive frame supporting the top drive motor and the rotary output member, possibly with an intermediate gear arrangement between the motor and the rotary output member, possibly with other top drive associated elements, e.g. like a grabber, mud saver valve, etc. The frame is mobile mounted to the carriage causing the frame to be displaceable between a non-operative retracted position on the one hand and a position wherein the rotary output member is aligned with the firing line on the other hand. In an embodiment of the mast as a U-shaped horizontal cross section mast, it is envisaged in an embodiment that the top drive frame is close to the rear wall of the U-shaped mast when in the non-operative retracted position and in a more forward position when in drilling mode, so that the rotary output member is aligned with the firing line, e.g. said firing line being located in a plane through vertical front posts of the mast.

In an embodiment, the top drive frame is supported on the carriage by a support arm that is pivotally connected to the carriage and the top drive frame, wherein the actuator assembly comprises one or more actuators between the traveling carriage and the support arm and one or more actuators between the traveling carriage and the top drive frame. For example the actuators are hydraulic cylinders.

In an embodiment, the tripping operation elevator is suspended by one or more links that are each connected at an upper end thereof to a pivotal elevator support arm that is pivotally connected to the traveling carriage about a horizontal pivot axis, and the actuator assembly comprises one or more actuators between the top drive frame and the one or more links.

In an embodiment with the mast as a U-shaped horizontal cross section mast and with the top drive frame being mobile mounted to the carriage, it may be desirable to embody the carriage and top drive frame and top drive unit such that, in a non-operative retracted position the entirety of the carriage, top drive frame, and top drive unit is located within the contour of the mast, so not protruding from the open front end of the mast. For example this may allow for shipment of a mast section, e.g. in lying horizontally on a flatbed trailer, with the carriage, top drive frame, and top drive unit within the frame in non-operative position. It will be appreciated that this may be advantageous even in an embodiment wherein there is no tripping operation elevator as discussed herein, e.g. just a regular top drive mounted elevator.

In an embodiment, the tower is a mast having a U-shaped horizontal cross section with a left-hand mast wall, a rear mast wall, and a right-hand mast wall, and with an open front. For example the mast is composed of connectable mast sections, e.g. including a crown section provided with a crown block, a lower or floor section to be connected to the drill floor, and with one or more intermediate sections.

In an embodiment, the mast comprises left-hand and right-hand vertical front posts and vertical rear corner posts, with each front post being connected by bracings to a respective rear corner post to form the respective side wall of the mast and said rear corner posts being connected to each other by bracings to form the respective rear wall of the mast, with the mast having an open front side between the front posts.

In an embodiment, a vertical rails is fixed to each of the vertical front posts and the traveling carriage is guided along said vertical rails, so that the carriage travels between these rails, e.g. with the top drive unit mainly within the contour of the U-shaped cross section mast, at least in the tripping mode.

In an embodiment, the carriage travels between two vertical rails that extend in a vertical plane that encompasses the firing line, e.g. said rails being fixed to vertical front posts of a U-shaped horizontal cross section mast.

In an embodiment, the carriage comprises a structural frame with a left-hand carriage frame member and a right-hand carriage frame member interconnected by one or more transverse frame members, wherein said transverse frame members extend rearward of the firing line to provide the mentioned unobstructed zone allowing the lateral removal of the tubulars stand in forward direction.

In an embodiment, a left-hand sheave assembly is mounted on the left-hand carriage frame member and a right-hand sheave assembly on the right-hand carriage frame member with said unobstructed zone passing between these sheave assemblies.

In an embodiment, the carriage has left-hand and right-hand carriage frame members that are each provided with one or more rail followers, e.g. rollers and/or glide bearings, that engage on two vertical guide rails between which the carriage travels.

In an embodiment, the top drive system further comprises a drilling operation elevator, distinct from the tripping operation elevator, which drilling operation elevator is adapted to retain a drilling tubular in vertical orientation below the rotary output member of the top drive unit. The drilling elevator is commonly used in the field, e.g. for use in stand building and other activities. In an embodiment the drilling elevator comprises an annular elevator body that can be opened to allow introduction of a tubular in the elevator and then closed to form a closed annular body around the tubular, e.g. an actuator being provided for remote controlled opening and closing of the drilling elevator body. As is known in the field the closed annular elevator body may engage underneath a shoulder formed by an enlarged diameter portion of a tubular, e.g. a connector, e.g. a threaded connector at the end of the tubular.

In an embodiment, as is known in the field the drilling operation elevator is suspended from the top drive unit. For example the drilling operation elevator is suspended by means of a pair of links or bails that are pivotally connected at their upper ends to the top drive unit. In an embodiment a tilt mechanism is provided that engages on the links or bails of the drilling operation elevator and adapted to move the links between tilted orientations and a vertical orientation.

In an embodiment, a left-hand fingerboard device is mounted to the left-hand side of the mast and a right-hand side fingerboard device is mounted to the right-hand side of the mast.

Placing these fingerboards to the sides of the mast is advantageous, e.g. in view of a line of vision from an operator cabin onto the front side of the mast where the top drive system travels. As preferred in this arrangement the mast is a U-shaped horizontal cross-section mast with left-hand and right-hand side walls, a rear wall, and an open front, e.g. having one or more features as discussed herein. Preferably each of these fingerboard devices has fingers defining slots that extend parallel to the respective side of the mast and are open at the front side of the fingerboard device. In another embodiment the fingerboard device is semicircular, wherein the slots that are open at the front are arranged on lines emanating from a common center, e.g. the center being located near the tubulars racking device. So the stands are effectively stored to the left and the right of the mast, and do not hinder the view onto the front side of the mast.

In an embodiment, the tubulars racking device comprises one or more mobile tubulars gripper assemblies with one or more grippers adapted to grip a tubular or tubulars stand and move the tubular or tubulars stand between each fingerboard device and the firing line. As mentioned it is known and preferred for said tubulars racking device to be mechanized and to allow for remote control thereof, e.g. from an operator cabin, e.g. allowing for fully or semi-automatic operation based on a suitably programmed computerized control unit, e.g. as part of a fully or semi-automatic control of a tripping process.

In an embodiment, a left-hand fingerboard device is mounted to the left-hand side of the mast and a right-hand side fingerboard device is mounted to the right-hand side of the mast with slots for the stands at the front side of each fingerboard device. A tubulars racking device comprises a structural frame supported by the mast, at an elevated position thereon relative to the drill floor, wherein said structural frame comprises one or more horizontal rails extending across the open front side of the mast and across the front sides of the fingerboard devices. The tubulars racking device further comprises a mobile tubulars gripper assembly guided by said one or more rails and provided with one or more grippers and adapted to grip a tubular stand and move the tubulars stand between the fingerboard devices and the firing line. The tubulars racking device is embodied to allow for vertical passage of the top drive system in its drilling mode as well as in its tripping mode, e.g. with the tripping operation elevator being brought in a position forward of the mast when in drilling mode. Preferably the mobile tubulars gripper assembly is movable both in X direction (along the mentioned one or more rails of the structural frame) and in Y direction (in forward and rearward direction perpendicular to said rail or rails) in a horizontal plane. In another embodiment the mobile tubulars gripper assembly is rotatable about a vertical axis in combination with a fingerboard device having slots oriented on lines emanating from said vertical axis.

In an embodiment, the structural frame of the racking device comprises a roof that extends over the rails so as to shield them, e.g. with one rails being an overhead rails extending underneath the roof.

In an embodiment, a mobile tubulars gripper assembly of the tubulars racking device is provided with an auxiliary winch and a winch driven cable, preferably the mobile tubulars gripper assembly being movable both in X and Y directions in a horizontal plane, wherein the mobile tubulars gripper assembly is positionable at least in a position such that the winch driven cable is aligned above the well center and can be lowered to the well center on the drill floor to perform lifting operations above or near the well center using the auxiliary winch on the mobile tubulars gripper assembly of the tubulars racking device. This basically allows for the use of the tubulars racking device as a crane for lifting objects that have to be placed at the well center or removed from the well center. For example this crane may be employed to handle an RCD (rotating control device) device for managed pressure drilling operations, the tripping operation elevator when replacement is needed, the slip device, etc.

In an embodiment, the tower, e.g. a U-shaped horizontal cross section mast, is provided at the top thereof with an auxiliary crane having a base secured to the tower and a crane boom connected via a vertical axis slew bearing to the base allowing to slew the boom, e.g. about a full revolution. Herein the auxiliary crane comprises a winch and a winch driven cable for hoisting of objects. The auxiliary crane is embodied such that the winch driven cable can be passed vertically along the firing line down to the well center in the tripping mode of the top drive system so as to allow for use of the auxiliary crane for lifting operations at or near, or towards and away from, the well center.

In an embodiment, the auxiliary crane at the top of the mast is a jib or cantilever crane, wherein the boom extends permanent in horizontal direction and wherein a trolley is displaceable along the boom, with the trolley being provided with a sheave and/or the winch, and the trolley is at least positionable so that the winch driven cable passing over said sheave and/or depending from the winch is aligned with the firing line, and a position remote from said firing line position.

The invention also relates to a drilling rig configured to perform drilling and/or other wellbore related activities, the drilling rig comprising:

- a drilling tower;
- a drill floor with a well center positionable above a wellbore;
- a slip device adapted to suspend a drilling tubulars string in the wellbore;
- a tubulars connection makeup and breaking device;
- a top drive system;
- a vertical motion drive adapted to cause vertical motion of the top drive system relative to the drilling tower in order to perform drilling and tripping operations;
- a fingerboard device adapted to store drilling tubular stands, wherein the drilling tower is provided with one or more vertical rails parallel to a vertical firing line that extends through the well center, wherein the drilling rig further comprises a tubulars racking device comprising one or more mobile tubulars gripper assemblies with one or more grippers adapted to grip a drilling tubular or drilling tubulars stand and move the drilling tubular or drilling tubulars stand between the fingerboard device and the firing line, wherein the top drive system comprises:

- a traveling carriage that is vertically mobile along said one or more vertical rails of the drilling tower by means of said vertical motion drive,
- a top drive unit supported by said traveling carriage and comprising a top drive motor and a rotary torque output member adapted to be engaged with a top end of a drilling tubulars string extending in a firing line through the well center to impart torque to said drilling tubulars string in order to perform drilling or other wellbore related operations, wherein the top drive system comprises a tripping operation elevator that is adapted to be engaged with a drilling tubulars string or drilling tubulars stand in order to perform tripping operations, wherein the top drive unit and the tripping operation elevator are mobile relative to the carriage, and wherein the top drive system is provided with an actuator assembly that is adapted to cause said relative motion of the top drive unit and of the tripping operation elevator so as to provide:

- a wellbore drilling mode;
- a tripping mode; and
- a bypassing mode, wherein the top drive unit and the actuator assembly are configured to move the top drive unit by means of said actuator assembly between an operative position of the top drive unit, in which the rotary torque output member is aligned with the firing line, and a retracted position of the top drive unit, wherein the tripping operation elevator and the actuator assembly are configured to move the tripping operation elevator by means of said actuator assembly between an operative position of the tripping operation elevator, in which the tripping operation elevator is aligned with the firing line, and a non-operative position of the tripping operation elevator away from the firing line, wherein, in the wellbore drilling mode, the top drive unit is positioned in the operative position thereof and the tripping operation elevator is positioned in a non-operative position thereof away from the firing line, wherein, in the tripping mode, the top drive unit is positioned in the retracted position thereof and the tripping operation elevator is positioned in the operative position thereof, such that an unobstructed zone is present vertically above the tripping operation elevator allowing the top drive system to be lowered along a drilling tubulars stand held by the slip device in the firing line above the well center, at least until the top drive system has passed below a top end of said drilling tubulars stand, wherein the top drive system is embodied such that when the top drive system is lowered at least below the top end of said drilling tubulars stand, said drilling tubulars stand is removable from the firing line, primarily in lateral direction, by means of the tubulars racking device, to allow for placement of said drilling tubulars stand in said fingerboard device, wherein, in the bypassing mode, the top drive unit is positioned in the retracted position and the tripping operation elevator is positioned in a retracted position away from the firing line in a direction corresponding to the direction of retraction of the top drive unit, and wherein, in the bypassing mode, both the top drive unit and the tripping operation elevator have a clearance from the firing line that is such that, with the tubulars racking device engaging on a drilling tubulars stand held by the slip device in the firing line above the well center, the top drive system is able to pass the location where the tubulars racking device engages on said drilling tubulars stand.

The invention also relates to a method for tripping out a drilling tubulars string from a wellbore, wherein use is made of a drilling rig according to the invention, comprising the following steps:

a) suspending a drilling tubulars string in the wellbore by means of the slip device, b) bringing the top drive system in said tripping mode, c) lowering the traveling carriage so that the tripping operation elevator reaches an initial engagement level and then connecting the tripping operation elevator with a top end of the suspended drilling tubulars string, d) releasing the slip device and lifting the carriage, so as to pull up a tubulars stand above the well center, e) engaging the slip device to suspend the drilling tubulars string, f) lowering the traveling carriage to as to move the tripping operation elevator to said initial engagement level for renewed pull up of a next tubulars stand, in which method at least one of the following steps is performed in time overlap with said lowering of the carriage:

disconnecting the lifted tubulars stand from the suspended drilling tubulars string by means of said tubulars connection makeup and breaking device near the well center, removing the disconnected tubulars stand from the firing line, primarily in a lateral direction, involving gripping the stand with the racking device, placing the drilling tubulars stand in said fingerboard device, g) when the tripping operation elevator has reached said initial engagement level, connecting the tripping operation elevator to the top end of the suspended drilling tubulars string, wherein during lowering of the carriage, the top drive system is temporarily brought into the bypassing mode to pass the location where the tubulars racking device engages on said drilling tubulars stand and after said passing is returned to the tripping mode.

The invention also relates to a method for tripping out a drilling tubulars string from a wellbore, wherein use is made of a drilling rig according to the invention, comprising the following steps:

a) bringing the top drive system in said tripping mode, b) lowering the traveling carriage so that the tripping operation elevator reaches an initial engagement level and then connecting the tripping operation elevator with a top end of a drilling tubulars string that is suspended in the wellbore by means of the slip device, c) releasing the slip device and lifting the travelling carriage and thereby pulling up a tubulars stand of said drilling tubulars stand above the well center, d) engaging the slip device to suspend the drilling tubulars string, e) lowering the traveling carriage to as to move the tripping operation elevator to said initial engagement level for a renewed pull up of a next tubulars stand, in which method at least one of the following steps is performed in time overlap with said lowering of the carriage:

disconnecting the lifted tubulars stand from the suspended drilling tubulars string by means of said tubulars connection makeup and breaking device near the well center, removing the disconnected tubulars stand from the firing line, primarily in a lateral direction, involving gripping the stand with the racking device, placing the drilling tubulars stand in said fingerboard device, f) when the tripping operation elevator has reached said initial engagement level, connecting the tripping elevator to the top end of the suspended drilling tubulars string, wherein, during lowering of the carriage, the top drive system is temporarily brought into the bypassing mode to pass the location where the tubulars racking device engages on said drilling tubulars stand and after said passing is returned to the tripping mode.

The invention further relates to a method for drilling a drilling tubulars string into a wellbore, wherein use is made of a drilling rig according to the invention, comprising the following steps:

a) suspending a drilling tubulars string in the wellbore by means of the slip device with a drilling tubulars stand connected to the drilling tubulars string and extending above the well center;

b) bringing the top drive system in the wellbore drilling mode;

c) connecting the rotary torque output member to a top end of the drilling tubulars stand;

d) releasing the slip device and imparting a torque to the top end of the drilling tubulars stand;

e) drilling the drilling tubulars string into the wellbore until the top drive system comes in proximity of the drill floor;

f) engaging the slip device to suspend the drilling tubulars string;

g) disconnecting the rotary torque output member from the top end of the drilling tubulars string;

h) bringing the top drive system into the bypassing mode;

i) lifting the carriage;

in which method at least one of the following steps is performed in time overlap with said lifting of the carriage:

removing a drilling tubulars stand from the fingerboard device using the racking device;

placing the drilling tubulars stand in the firing line with the racking device;

connecting the tubulars stand to the suspended drilling tubulars string by means of said tubulars connection makeup and breaking device near the well center;

j) bringing the top drive system into the drilling mode;

k) connecting the top drive system to the top end of the drilling tubulars stand connected to the suspended drilling tubulars string.

The invention further relates to a method for drilling a drilling tubulars string into a wellbore, wherein use is made of a drilling rig according to the invention, comprising the following steps:

a) bringing the top drive system in the wellbore drilling mode;

b) connecting the rotary torque output member to a top end of the drilling tubulars stand that is suspended in the wellbore by means of the slip device with a drilling tubulars stand connected to the drilling tubulars string and extending above the well center;

c) releasing the slip device and imparting a torque to the top end of the drilling tubulars stand;

d) drilling the drilling tubulars string into the wellbore until the top drive system comes in proximity of the drill floor;

e) engaging the slip device to suspend the drilling tubulars string;

f) disconnecting the rotary torque output member from the top end of the drilling tubulars string;

g) bringing the top drive system into the bypassing mode;

h) lifting the carriage;

in which method at least one of the following steps is performed in time overlap with said lifting of the carriage:

removing a drilling tubulars stand from the fingerboard device using the racking device;

placing the drilling tubulars stand in the firing line with the racking device;

connecting the tubulars stand to the suspended drilling tubulars string by means of said tubulars connection makeup and breaking device near the well center;

i) bringing the top drive system into the drilling mode;

j) connecting the top drive system to the top end of the drilling tubulars stand connected to the suspended drilling tubulars string.

In an embodiment, the top drive system is brought into the bypassing mode during lifting of the carriage to pass the racking device.

In an embodiment, the top drive system is first brought into the tripping mode before being brought to the bypassing mode and after passing the racking device is brought first into the tripping mode before being brought into the drilling mode.

The invention also relates to a top drive system for use in a drilling rig having a drilling mast, for example a mast with a U-shaped horizontal cross section with a left-hand mast wall, a rear mast wall, and a right-hand mast wall, and with an open front side, e.g. said mast being composed of interconnected mast sections, wherein the mast, e.g. the left-hand and right-hand walls of the mast, is provided with one or more vertical rails that are—in use of the drilling rig—parallel to a vertical firing line that extends through a well center, wherein the top drive system comprises:

a traveling carriage that is adapted to be vertically mobile along said one or more vertical rails of the drilling mast by means of a vertical motion drive, a top drive unit supported by said carriage and comprising a top drive motor and a rotary torque output member, e.g. a rotary stem, adapted to be engageable with a top end of a drilling tubulars string extending in a firing line through the well center to impart torque to said drilling tubulars string in order to perform drilling operations, wherein the top drive system further comprises a tripping operation elevator that is adapted to be engageable with a drilling tubulars string or drilling tubulars stand, e.g. with the top end thereof, in order to perform tripping operations, wherein the top drive unit and the tripping operation elevator are mobile relative to the traveling carriage, and wherein the top drive system is provided with an actuator assembly that is adapted to cause said relative motion of the top drive unit and of the tripping operation elevator so as to provide:

a wellbore drilling mode;

a tripping mode;

a bypassing mode, wherein the top drive unit is moveable by said actuator assembly between an operative position, in which the rotary torque output member is aligned with the firing line, and a retracted position, wherein the tripping operation elevator is moveable by said actuator assembly between an operative position, in which the tripping operation elevator is aligned with the firing line, and a non-operative position away from the firing line, wherein, in the wellbore drilling mode, the top drive unit is positioned in the operative position and the tripping operation elevator is positioned in a non-operative position away from the firing line, wherein, in the tripping mode, the top drive unit is positioned in the retracted position and the tripping operation elevator is positioned in the operative position, such that an unobstructed zone is present vertically above the tripping operation elevator allowing the top drive system to be lowered along a drilling tubulars stand held by the slip device in the firing line above the well center, at least until the top drive system has passed below a top end of said drilling tubulars stand, wherein the top drive system is embodied such that when the top drive system is lowered at least below the top end of said drilling tubulars stand, said drilling tubulars stand is removable from the firing line, primarily in lateral direction by means of the tubulars racking device, to allow for placement of said drilling tubulars stand in said fingerboard device, wherein, in the bypassing mode, the top drive unit is positioned in the retracted position and the tripping operation elevator is positioned in a retracted position away from the firing line in a direction corresponding to the direction of retraction of the top drive unit, and wherein, in the bypassing mode, both the top drive unit and the tripping operation elevator are cleared from the firing line to such an extent that, with the tubulars racking device engaging on a drilling tubulars stand held by the slip device in the firing line above the well center, the top drive system is able to pass the location where the tubulars racking device engages on said drilling tubulars stand.

The present invention also relates to a drilling rig, mast, top drive system, carriage, racking device, or combinations thereof as disclosed herein, e.g. as shown in the drawings.

The present invention also relates to a method for drilling with a drill string and/or tripping a drill string wherein use is made of a drilling rig, mast, top drive system, carriage, racking device, or combinations thereof as disclosed herein, e.g. as shown in the drawings. For example the method involves the step of switching between drilling and tripping.

The invention will now be described in a non-limiting way by reference to the accompanying drawings in which like parts are indicated by like reference symbols.

DETAILED DESCRIPTION OF EMBODIMENTS

Figure 1:
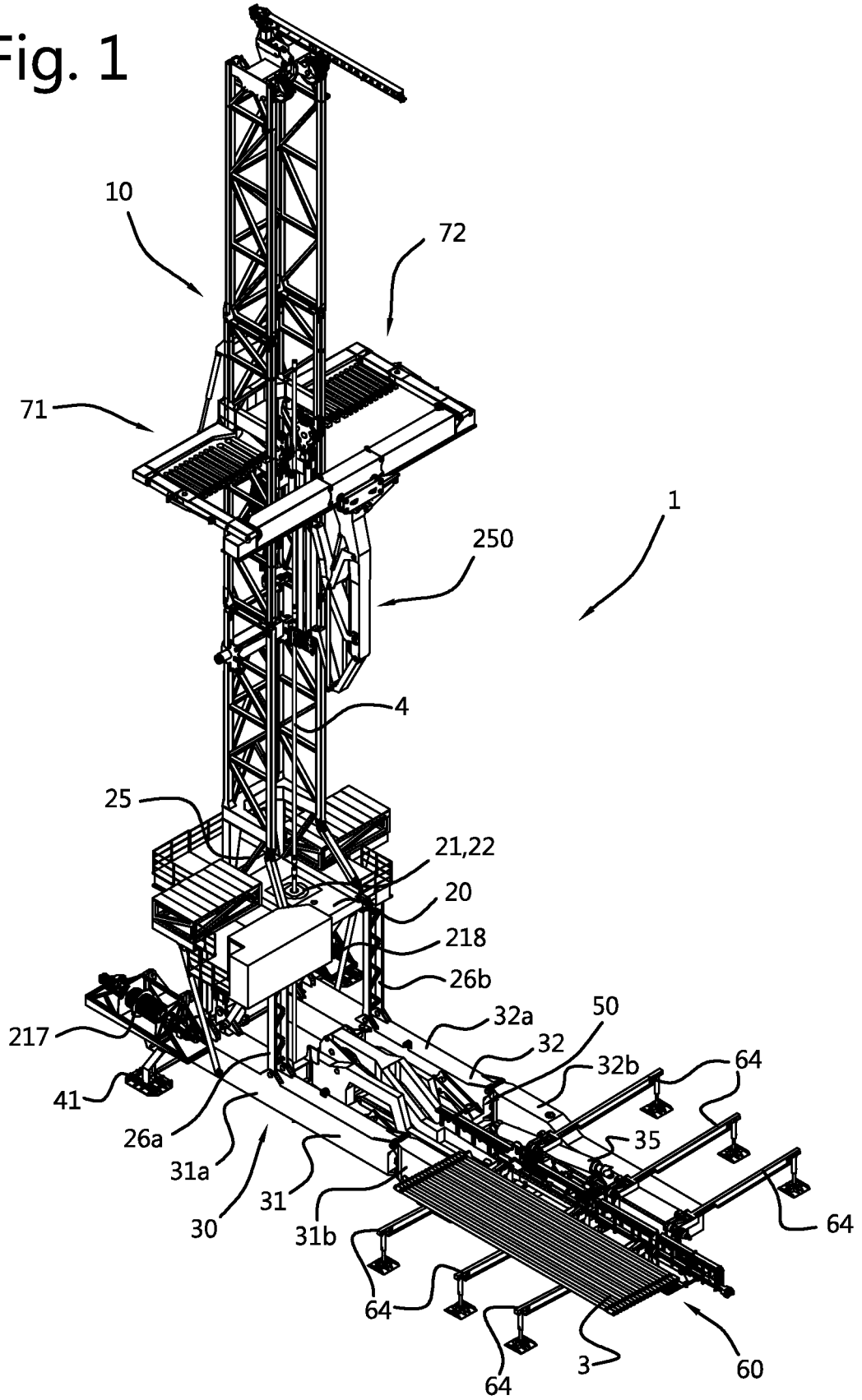
FIG. 1 depicts in perspective view a drilling rig according to an embodiment of the invention.
Figure 2:
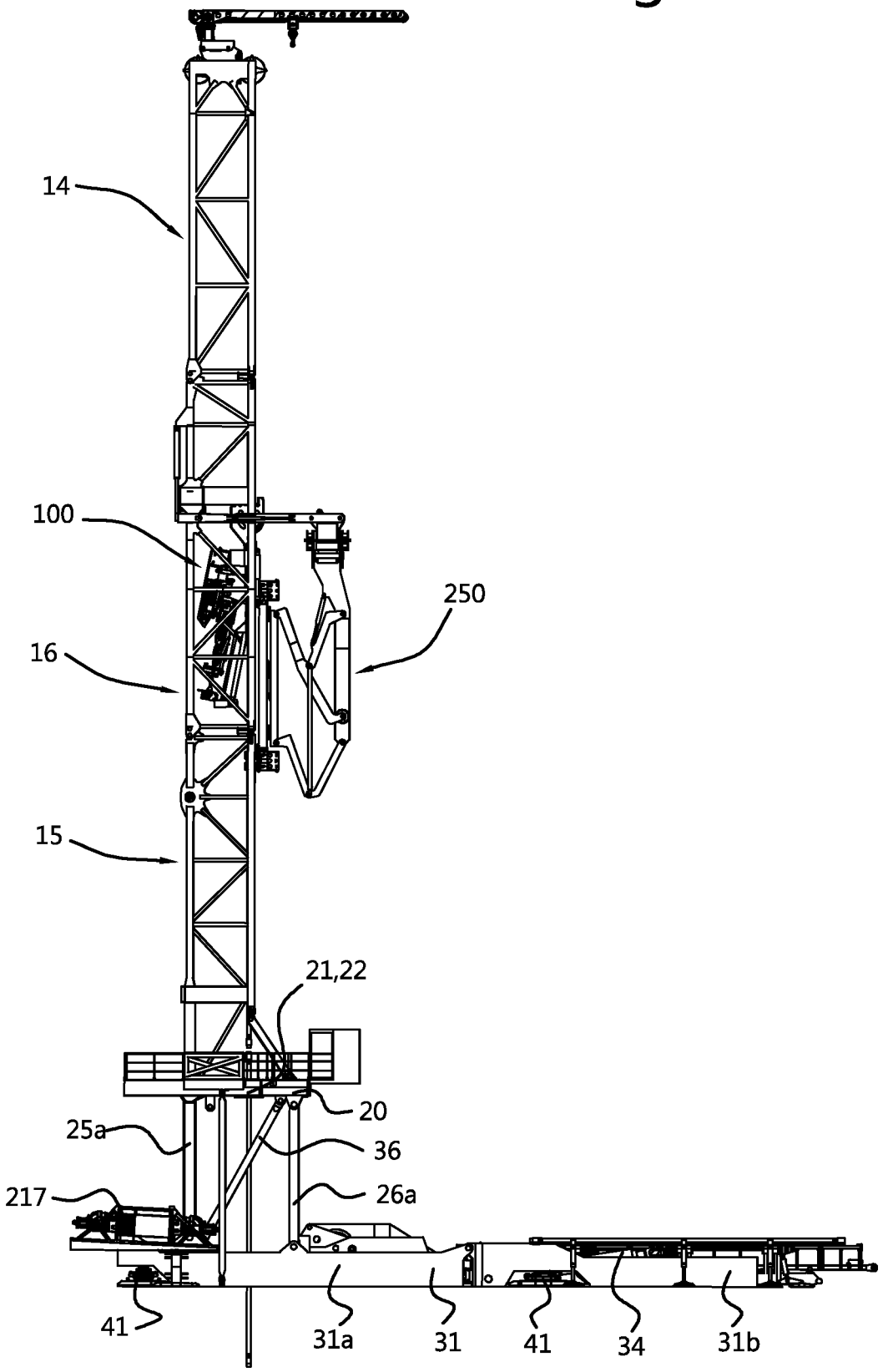
FIG. 2 depicts the rig of FIG. 1 in side view.

FIGS. 1 to 4 show a drilling rig 1 for drilling a wellbore and for other wellbore related activities, e.g. for plug and abandonment of non-productive wellbores, well intervention, etc.

In this example the rig 1 is a mobile rig composed of modules that are transportable by road vehicles from one drilling site to another. The invention and aspects thereof may however also be of use in non-mobile rigs and/or non-modular rigs, e.g. rigs with a derrick structure over a moonpool on an offshore drilling vessel.

The rig 1 comprises a drilling tower 10, which is embodied here as a mast. In another embodiment the tower 10 can be embodied as a derrick.

The mast 10 has a U-shaped horizontal cross section with a left-hand mast wall 11*a*, a rear mast wall 11*b*, and a right-hand mast wall 11*c*, and with an open front side 12.

The mast comprises left-hand and right-hand vertical front posts 13*a*, 13*d*, and rear corner posts 13*b*, 13*c*. Each front post 13*a,d* is connected by bracings, here a combination of horizontal and diagonal bracings, to a respective rear corner post 13*b*, 13*c* to form the side walls 11*a*, 11*c* of the mast. The rear corner posts 13*b*, 13*c* are also connected by bracings.

In view of the transportation of the drilling rig 1 the mast 10 is composed of multiple sections, including a crown section 14 at the top of the mast, a floor section 15 at the lower, and one or more intermediate mast sections 16. For example, as here, the vertical posts 13*a,b,c,d* are provided with connector members to secure the mast sections one on top of the other. The floor section 15 may be provided at its lower end with a pivot structure defining a horizontal pivot axis allowing the mast 10, preferably assembled in horizontal state, to be erected.

The rig 1 comprises a drill floor 20 with a well center 21.

As is preferred a slip device 22 is arranged at the well center 21, e.g. a mechanized and remotely controllable slip device with one or more mobile slip members. The slip device 22 is adapted to support a drill string or other tubular string that extends into the wellbore.

On the drill floor 20 further a tubulars connection makeup and breaking device 25 is arranged near the well center 21, e.g. an iron roughneck machine and/or a mechanized power tong device.

In this example, the drill floor 20 is arranged in a mobile manner on a base structure 30 of the rig so as to be movable between a collapsed or assembly position on the one hand and a raised or operative position relative to the base structure 30 on the other hand (as shown in the figures).

FIG. 1 illustrates that the base structure comprises a left-hand base member 31 and a right hand base member 32, each composed of two elongated parts 31*a*, 31*b*, 32*a*, 32*b* that are connected end-to-end.

Between the drill floor 20 and each base member 31, 32, here parts 31*a*, 32*a* thereof, two legs 25*a*, 26*a,b* extend that are pivotally connected to both the drill floor and the base member 31, 32 to form a parallelogram. If desired more parallel legs can be provided between each base member and the drill floor.

Each base member 31, 32 is further provided with a telescopic hydraulic cylinder 34, 35 that is connectable to the drill floor 20 for moving the drill floor 20 between the collapsed and raised position thereof. If desired another motorized drive, e.g. including a winch, may be provided for this purpose.

FIG. 1 illustrates the presence of a locking beam 36 to lock the drill floor in its raised position. The figures illustrate that the base structure, here the members 31, 32, are provided with displacement feet 41, 41 allowing the rig 1, in erected state, to be displaced over the drill site, e.g. from one wellbore to an adjacent wellbore. An example thereof is explained in WO2013/109147 of the present applicant.

The drill floor 20 in its raised position allows for the arrangement of a BOP and/or other wellbore related equipment underneath the drill floor.

The mast, base structure, and/or drill floor of the drilling rig could also be embodied as described in for example WO2013/133698 or in WO2014/178712 of the present applicant.

FIG. 1 also depicts the presence of a tubulars handling device 50 adapted to move tubulars between a vertical position aligned with the firing line through the well center 21 and a horizontal pick-up position. The depicted device is embodied as described in WO2014/133389 of the present applicant, which is incorporated by reference herein. In another embodiment, for example, the tubulars handling device 50 can be designed as described in WO2006/038790 of the present applicant.

FIG. 1 also depicts the presence of a tubulars bin system 60, e.g. in an embodiment as disclosed in WO2013/109148 of the present applicant with bins (not shown) for storage and transportation of drilling tubulars, e.g. drill pipe joints 3, as well as an arrangement of slide bars 64 that allow for motion of the tubulars between the bins and the tubulars handling device 50.

The mast 10, here intermediate section 16 thereof, is provided with one or more fingerboard devices 71, 72 that are adapted to store drilling tubulars stands assembled from multiple drilling tubulars 3, here three as the stands are so-called triples having a length of about 90 ft.

As illustrated a left-hand fingerboard device 71 is mounted to the left-hand side 11*a* of the mast and a right-hand side fingerboard device 72 is mounted to the right-hand side 11*c* of the mast. Each of these fingerboard devices 71, 72 has fingers defining slots that extend parallel to the respective side of the mast and are open at the front side of the fingerboard device 71, 72.

The lower ends of the stored tubulars stands may be supported on a non-depicted lower end support member for the stands.

The rig 1 further comprises a top drive system 100 and a vertical motion drive that is adapted to cause vertical motion of the top drive system 100 relative to the drilling tower 10 in order to perform drilling and tripping operations.

First the top drive system 100 will be discussed by reference to FIGS. 5A-7B. The top drive system 100 comprises:

- a traveling carriage 110 that is vertically mobile along vertical rails 17, 18 arranged on the front vertical posts 13*a*, 13*d* in the opening 12 of the drilling tower by means of the vertical motion drive,
- a top drive unit 120 that is supported by the carriage 110 and comprises a top drive motor 125 and a rotary torque output member 126, e.g. a rotary stem, that is adapted to be engageable with a top end of a drilling tubulars string extending in the firing line 23 through the well center 21 to impart torque to the drilling tubulars string in order to perform drilling operations,
- a tripping operation elevator 150 that is adapted to be engageable with a drilling tubulars string or drilling tubulars stand 4, e.g. with the top end thereof, in order to perform tripping operations.

The figures illustrate that each of the front vertical posts 13*a, d* of the mast 10 is provided with a corresponding vertical rail 17, 18 that is static in its vertical position, so non-mobile relative to the tower 10.

The carriage 110 is provided with rail followers 111, e.g. rollers and/or glide members, so that the carriage is only vertically mobile up and down relative to the mast, at least over the height of the stands 4 to be handled.

In general terms, as will be explained in more detail below, the top drive unit 120 and the tripping operation elevator 150 are each mobile relative to the traveling carriage 110.

Figure 6A:
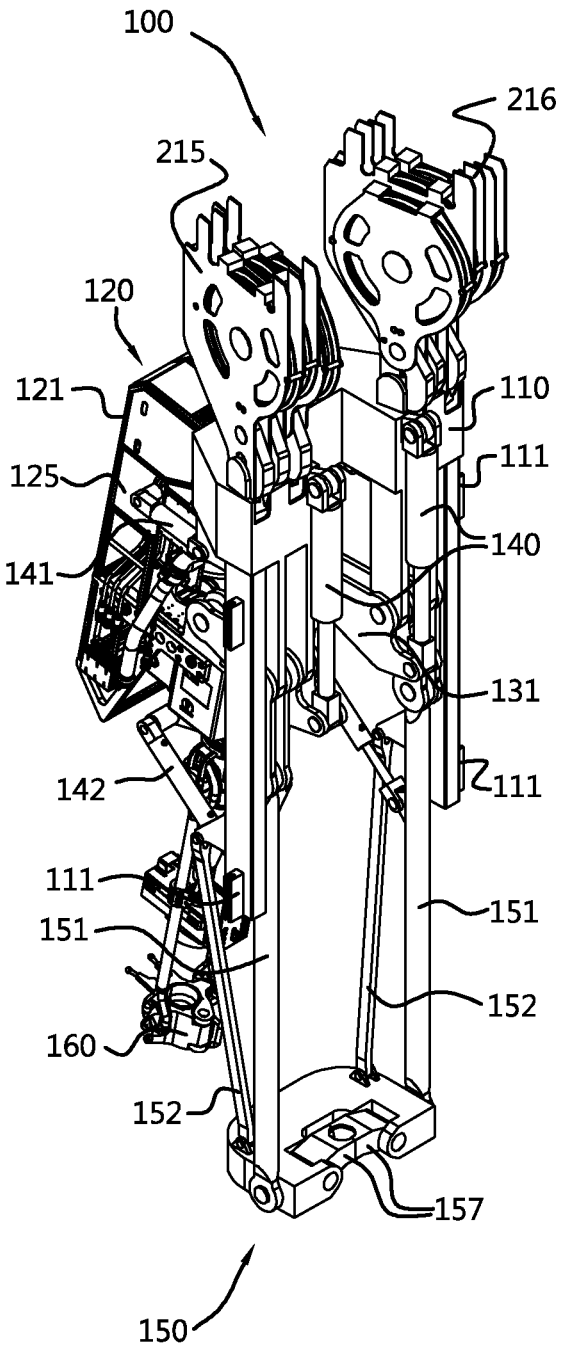
FIGS. 6A-B depict the top drive system of the rig of FIG. 1 in a tripping mode.
Figure 6B:
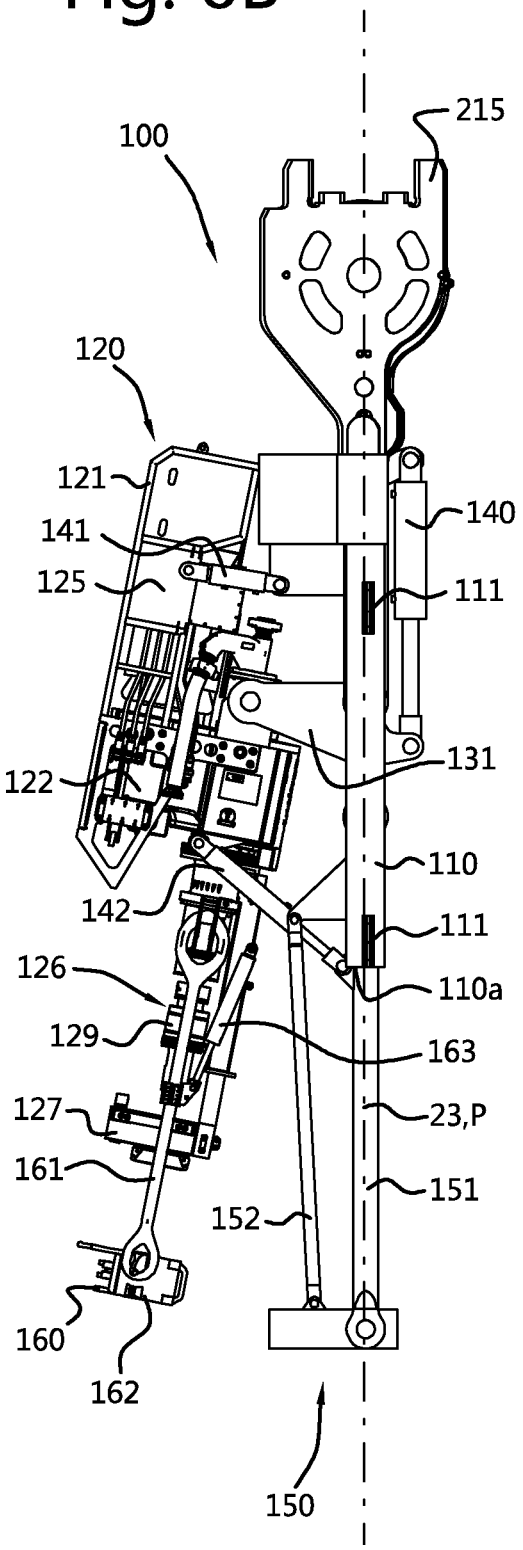
Figure 7A:
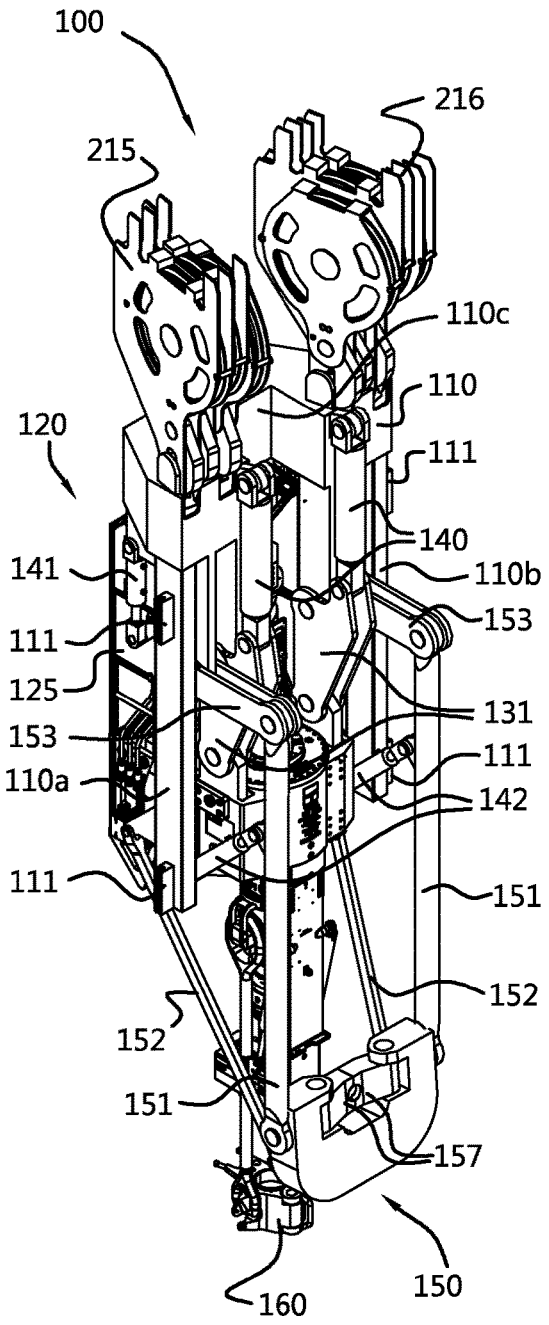
FIGS. 7A-B depict the top drive system of the rig of FIG. 1 in a drilling mode.
Figure 7B:
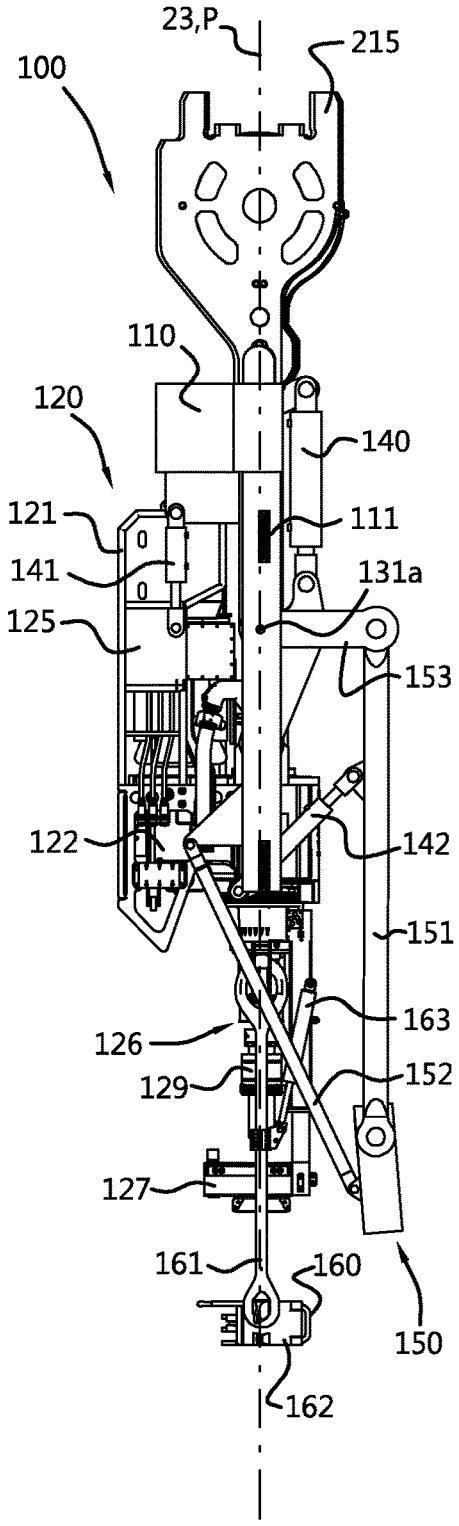

Furthermore the top drive system is provided with an actuator system that is adapted to cause the relative motion of the top drive unit 120 and of the tripping operation elevator 150 so as to provide:

- a bypassing mode (see FIGS. 5A, 5B)
- a tripping mode (see FIGS. 6A, 6B),
- a wellbore drilling mode (see FIGS. 7A, 7B).

In the wellbore drilling mode the top drive unit 120 is in operative position thereof with the rotary torque output member 126 being aligned with the firing line 23. At the same time the tripping operation elevator 150 is in a non-operative position thereof remote, i.e. away, from the firing line 23, here forward of the firing line 23.

In the tripping mode the tripping operation elevator 150 is in operative position thereof aligned with the firing line 23 and at the same time the top drive unit 120 is in a retracted position thereof, here closer to the rear wall 11*b* of the C-cross section mast than in the operative drilling mode (e.g. compare FIGS. 6B and 7B).

In the bypassing mode the top drive unit 120 is positioned in the retracted position thereof and the tripping operation elevator 150 is positioned in a retracted position thereof away from the firing line in a direction corresponding to the direction of retraction of the top drive unit 120, here closer to the rear wall 11*b* of the C-cross section mast than in the operative tripping mode.

As illustrated the top drive system 100 is embodied such that—in the tripping mode—an unobstructed zone is present vertically above the tripping operation elevator 150 that allows the top drive system to be lowered along a drilling tubulars stand 4 in the firing line 23 above the drill floor 20, at least so that the top drive system is below the top end thereof, e.g. allowing lowering till near the drill floor. This will be explained in more detail later in conjunction with the fast tripping sequence depicted in FIGS. 12-21.

The top drive system 100 is also embodied such that—in the tripping mode and with the top drive system lowered at least below the top end of said drilling tubulars stand—the drilling tubulars stand 4 is removable from the firing line 23, primarily in lateral direction by means of tubulars racking device 250, to place the drilling tubulars stand 4 in a fingerboard device 71, 72. This allows for a fast tripping process to be conducted.

As illustrated the top drive system 100 is embodied such that—in the bypassing mode—both the top drive unit 120 and the tripping operation elevator 150 are cleared from the firing line 23 to such an extent that, with the tubulars racking device 250 engaging on a drilling tubulars stand 4 held by the slip device 22 in the firing line 23 above the well center 20, the top drive system 100 is able to pass the location where the tubulars racking device engages on said drilling tubulars stand. This will be explained in more detail later in conjunction with the fast tripping sequence depicted in FIGS. 12-21 and the fast drilling sequence depicted in FIGS. 22-33.

As illustrated the top drive system 100 here further comprises a drilling operation elevator 160, distinct from the tripping operation elevator 150, which elevator 160 is adapted to retain a drilling tubular or tubular stand 4 in vertical orientation below the rotary output member 126 of the top drive unit 120 in its operative position.

The top drive unit 120 comprises a top drive frame 121 that supports the top drive motor 125, a gear arrangement 122, and the rotary output member 126 that is supported by a bearing.

The top drive unit here further comprises a grabber 127 and a mud saver valve 129 as is known in the art.

The frame 121 is supported on the traveling carriage 110 by a mechanism comprising at each of the left-hand side and the right-hand side of the carriage and the frame a support arm 131.

These arms 131 are each pivotally connected to the carriage and the top drive frame to form two parallel and horizontal pivot axes 131*a*, 131*b*.

Actuators 140, e.g. hydraulic cylinders, are mounted between the traveling carriage 110 and the support arms 131. Here one hydraulic cylinder 140 is mounted at the left-hand side and one at the right-hand side of the carriage 110 and the respective support arm 131. Actuators 141, e.g. hydraulic cylinders, are mounted between the traveling carriage 110 and the top drive frame 121. Here one hydraulic cylinder 141 is mounted at the left-hand side and one at the right-hand side of the carriage 110 and the top drive frame 121.

As will be understood suitable actuation of the actuators 140, 141 causes the top drive unit 120 to be displaced relative to the carriage 110 between a position more inward in the mast 10 (closer to the rear wall 11*b* of the mast) as depicted in FIGS. 5A-6B and a more forward position wherein the rotary output member 126 is aligned with the firing line 23 as depicted in FIGS. 7A, 7B. As is preferred, even in said more forward position, a major portion of the top drive unit 120 is still within the contour of the mast 10.

The carriage comprises a structural frame with a left-hand carriage frame member 110*a* and a right-hand carriage frame member 110*b* interconnected by one or more transverse frame members 110*c*. These one or more transverse frame members extend rearward of the firing line 23 to provide the mentioned unobstructed zone allowing the lateral removal of the tubulars stand in forward direction.

As illustrated it is envisaged, as is preferred, that the firing line 23 is encompassed in a vertical plane P that extends between the front posts 13*a, d* of the mast 10, possibly between the guide rails 17, 18 so as to reduce any torsional loads.

The tripping operation elevator 150 is suspended by right-hand side and left-hand side links 151 or bails that are each connected at an upper end thereof from a respective pivotal elevator support arm 153 that is pivotally connected to the carriage 110 about a horizontal pivot axis 131*a*, and by right-hand side and left-hand side links 152 that are each pivotally connected at an upper end thereof to the carriage 110.

Actuators 142, e.g. hydraulic cylinders, are mounted between the top drive frame 121 and the links 151. Here, one hydraulic cylinder 142 is mounted at the left-hand side and one at the right-hand side of the top drive frame 121 and the respective link 151.

Figure 5A:
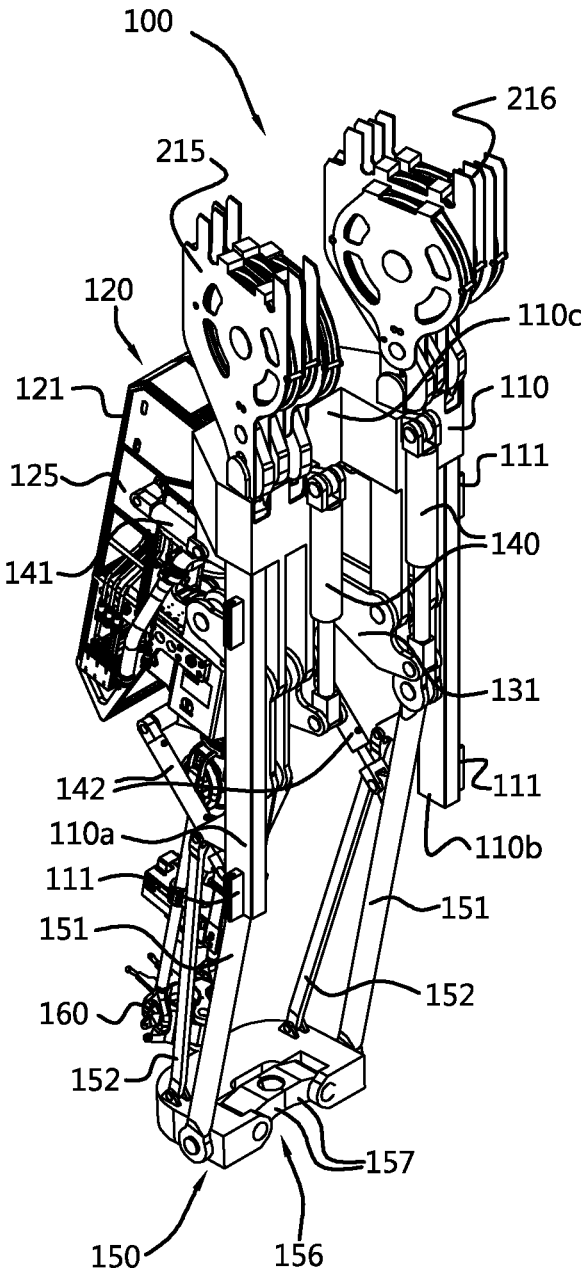
FIGS. 5A-B depict the top drive system of the rig of FIG. 1 in a bypassing mode.
Figure 5B:
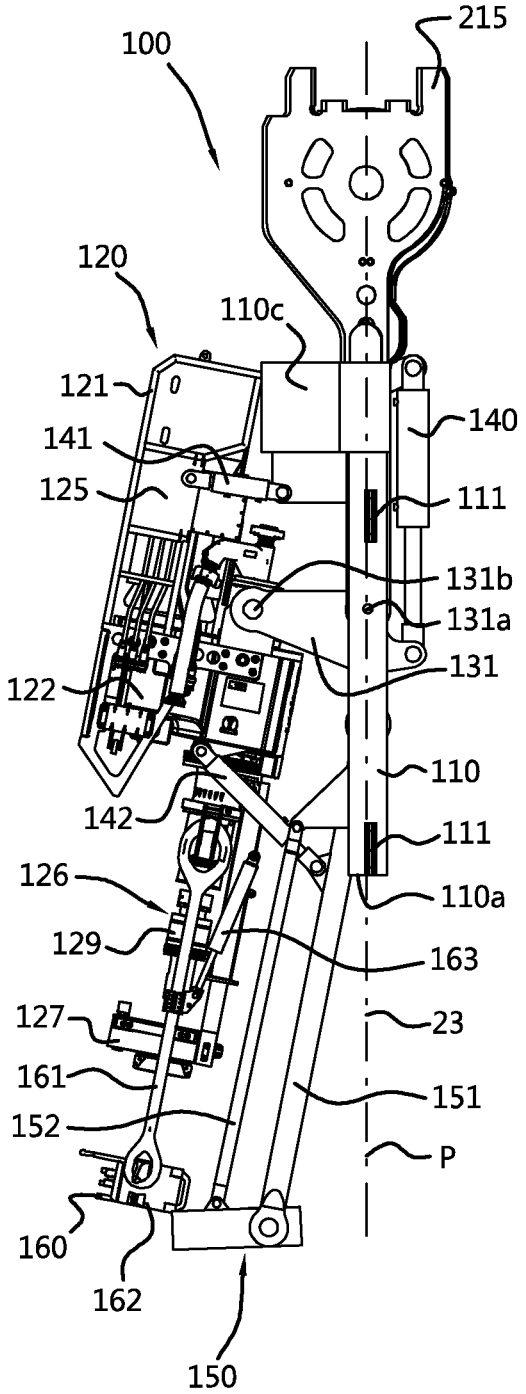

As will be understood, suitable actuation of the actuators 142 cause the tripping operation elevator 150 to be displaced relative to the top drive frame between a position more inward in the mast 10 (closer to the rear wall 11*b* of the mast) as depicted in FIGS. 5A, 5B, and a more forward position in which the tripping operation elevator 150 is aligned with the firing line 23 as depicted in FIGS. 6A, 6B.

As illustrated the elevator support arms 153 are each integrated with a respective support arm, here upper support arms 131 at the right-hand side and left-hand side of the carriage 110 so that each pair of an arm 153 and an arm 131 forms a one piece arms member that is pivotal about a horizontal axis 131*a* with the integrated arms 153 and 131 diverging.

The integration of a pair of arms 131, 153 into a one piece integrated pivotal arms member is one manner to achieve that the top drive unit 120 and the tripping operation elevator 150 are mechanically linked so as to move in unison when operating the one or more actuators 140, 141 in order to switch between the mentioned drilling mode, the mentioned tripping mode and/or the mentioned bypassing mode.

As will be appreciated, by the basically permanent presence of the tripping elevator 150 in the top drive system 100, even when not in use when in drilling mode or bypassing mode, a fast and efficient switching can be made between the drilling mode and the tripping mode. There is no need to then install the tripping elevator 150 at the time of switching, which is advantageous in view of demands for crew members.

In an embodiment one or more detent devices, e.g. remotely controllable, are provided to secure the top drive unit and/or the support for the tripping elevator relative to the traveling carriage 110 in the drilling mode and the tripping mode. For example one or more mobile detent members, e.g. pins, are provided on the carriage that engage in a corresponding hole in one or more of the support arms.

Of course, e.g. when different dimensions of tubulars to be handled would require a different tripping operation elevator, it is envisaged that the tripping operation elevator may be arranged in an exchangeable manner. For example, as discussed herein, a winch on the racking device 250 can then be used for lifting and handling the rather heavy elevator 150. In a preferred embodiment, as discussed herein, the elevator 150 has a body that is suited to all envisaged tubular diameters to be handled, e.g. just requiring the exchange or adjustment of one or more locking members for adaptation to a specific diameter.

The figures illustrate that the tripping operation elevator 150 comprises a C-shaped body in top view with a laterally open, e.g. to the front, vertical passage 156 through the elevator body that is dimensioned to allow unhindered passage of the elevator body along the drilling tubulars stand 4 in the firing line when the carriage 110 is lowered during tripping out, i.e. clearing any enlarged diameter portion(s) thereon formed by one or more connectors of the drilling tubulars stand.

The figures further illustrate that this elevator 150 comprises one or more mobile, here two pivotal, locking members 157, here on opposite sides of the vertical passage, which in a clearance position thereof (see detail of FIG. 15) allow for passage of the enlarged diameter portion(s) during descent of the carriage 110 in tripping and in a locked position (see e.g. FIG. 5A) engage underneath a shoulder formed by such an enlarged diameter portion, e.g. connector, e.g. threaded connector, of the tubular in order to allow the tubular, more in particular the tubulars string, to be lifted.

As can be seen e.g. in FIG. 5A two locking members 157 may be provided on the tripping operation elevator 150, each pivotal about a horizontal axis, e.g. each having a tubular facing end with a semi-circular recess adapted to the diameter of the tubular to be handled. An actuator may be provided for each locking member, e.g. allowing for remote control of the locking member.

It is illustrated that the drilling operation elevator 160 is equally suspended from links or bails 161 that are here pivotally suspended from the top drive unit 120.

As is known in the field the drilling operation elevator 160 comprises an annular elevator body 162 that can be opened to allow introduction of a tubular in the elevator and then closed to form a closed annular body around the tubular, e.g. an actuator being provided for remote controlled opening and closing of the drilling elevator body. As is known in the field the closed annular elevator body may engage underneath a shoulder formed by an enlarged diameter portion of a tubular, e.g. a connector, e.g. a threaded connector at the end of the tubular.

An actuator 163, e.g. a hydraulic cylinder, is provided to cause controlled tilting of the links 161 as is known in the art.

In order to move the traveling carriage 110 up and down along the mast 10, the mast crowns section is provided with a crown block assembly with a left-hand set 211 of sheaves and a right-hand set 212 of sheave, which sets are spaced apart from one another seen from the front of the mast so that an opening that is open at the front is present between the two sets, with the firing line 23 passing through this opening.

The sheaves of the sets 211, 212 have horizontal axes generally parallel and in or close to the plane P, here at a small angle. An equalizing sheave 213 of the crown block is provided more rearward, at the rear of the mentioned opening between the sets 211, 212.

The traveling carriage 110 is provided with a left-hand set 215 of sheaves and a right-hand set 216 of sheave with sheaves, which sets sheaves are spaced apart from one another seen from the front of the mast so that an opening that is open at the front is present between the two sets, with the firing line 23 passing through this opening.

As illustrate the set 215 is mounted at the top of frame member 110*a* and the set 216 at the top of frame member 110*b*.

The sheaves on the travelling carriage 110 are also rotatable about a horizontal sheave axis. The rig 1 is provided with one or more, here two, drawwork winches 217, 218; one on each side of the base structure. Both winches 217, 218 here connect to a single drawwork cable 219 which cable passes over the mentioned sheaves in two multiple fall groups along the right-hand side and left-hand side of the mast, here along the inside of the respective front post 13*a, d*, so as to suspend the traveling carriage 110 from the crown block.

As illustrated it is envisaged that one or more of the sheaves 215, 216 associated with the traveling carriage 110 may each be integrated in a respective detachable sheave block that is individually connectable and detachable, e.g. by remote control from an operator cabin, to the carriage 110 and which, when detached, may be locked (and unlocked), e.g. by remote control from an operator cabin, in an elevated position below the respective set of sheaves of the crown block. This allows to vary the active number of falls from which the carriage is suspended, e.g. allow for faster operation in situations wherein the load requirements are limited and allow for an increased number of active falls when high loads are to be handled.

As explained a left-hand fingerboard device 71 is mounted to the left-hand side 11*a* of the mast and a right-hand side fingerboard device 72 is mounted to the right-hand side 11*c* of the mast 10. As shown each fingerboard device has fingers defining slots that extend parallel to the respective side of the mast and are open at the front side of the fingerboard device to allow for lateral introduction and removal of a tubulars stand from the fingerboard.

As illustrated the drilling rig comprises a tubulars racking device 250 comprising one or more mobile tubulars gripper assemblies adapted to grip a tubular or tubulars stand 4 and move the tubular or tubulars stand between the fingerboard device 71, 72 and the firing line 23. The tubulars racking device 250 comprises a structural frame 400 supported by the mast 10, mainly at the front side thereof, at an elevated position thereon relative to the drill floor 20.

In this example, the structural frame 400 is connected to the left and right fingerboard devices 71, 72, respectively, via respective cantilevers 401, 402 extending from the left and right fingerboard devices 71, 72 in a forward direction.

Figure 3:
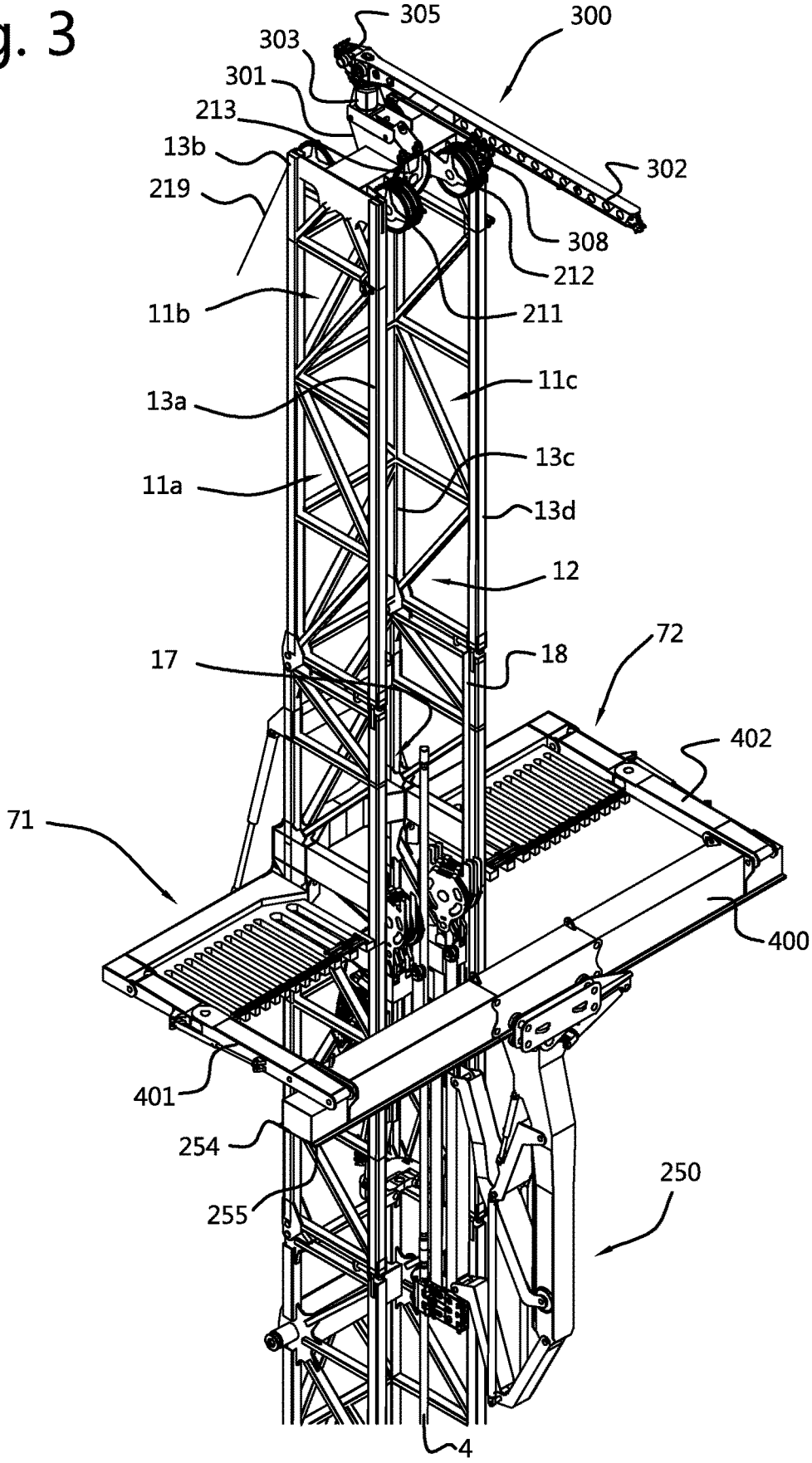
FIG. 3 depicts in perspective view an upper part of the rig of FIG. 1 on a larger scale.

As can be seen in FIG. 3, the structural frame 400 comprises one or more horizontal rails 254, 255 extending across the front side of the mast 10 and across the front sides of the fingerboard devices 71, 72.

The racking device 250 will now be described in more detail by reference to FIGS. 9A to 11B. The racking device 250 comprising a mobile tubulars gripper assembly 251 guided by said one or more rails 254, 255 and provided with one or more grippers 252, 253 and adapted to grip a tubular stand 4 and move the tubulars stand between the fingerboard devices 71, 72 and the firing line 23.

In this example the assembly 251 comprises a vertical carrier beam 256 which is supported by the one or more rails 254, 255 to allow travel in X-direction over said one or more rails 254, 255. The assembly further comprises a vertical carrier beam 407 to support the grippers 252, 253. The vertical carrier beam 407 mainly extends parallel to the vertical carrier beam 256.

The vertical carrier beam 407 is connected to the vertical carrier beam 256 via support beam 408 which is pivotally connected at one end to the vertical carrier beam 407 (indicated by location A) and slidably connected at the opposite end to the vertical carrier beam 256. To this end, the support beam 408 is provided with guide wheels 409 on either side of the vertical carrier beam 256 wherein the guide wheels 409 are received in corresponding guide recesses 256*a*.

The support beam 408 is further connected to the vertical carrier beam 256 via support beam 410 that is pivotally connected to the vertical carrier beam 256 (indicated by location B) and pivotally connected to the support beam 408 (indicated by location C).

The vertical carrier beam 407 is further connected to the vertical carrier beam 256 via two support beams 411, 412 arranged in series. Hence, one end of support beam 411 is pivotally connected to the vertical carrier beam 256 (indicated by location D) and one end of support beam 412 is pivotally connected to the vertical carrier beam 407 (indicated by location E) while the opposite ends of the support beams 411, 412 are connected to each other (indicated by location F).

In between the locations C and F two actuators 413, e.g. hydraulic cylinders, are provided. The assembly 251 is further configured such that a distance between locations B and C is equal to a distance between locations D and F, so that when a distance between locations C and F as set by the two actuators 413 is equal to a distance between locations B and D, a parallelogram is formed by the vertical carrier beam 256, the support beams 410, 411 and the two actuators 413. Because in this embodiment a distance between locations C and A is equal to a distance between locations E and F, the vertical carrier beam 407 is kept parallel to the vertical carrier beam 256 in all positions of the guide wheels 409 along the guide recesses 256*a*, i.e. in all orientations of support beam 408.

Figure 9A:
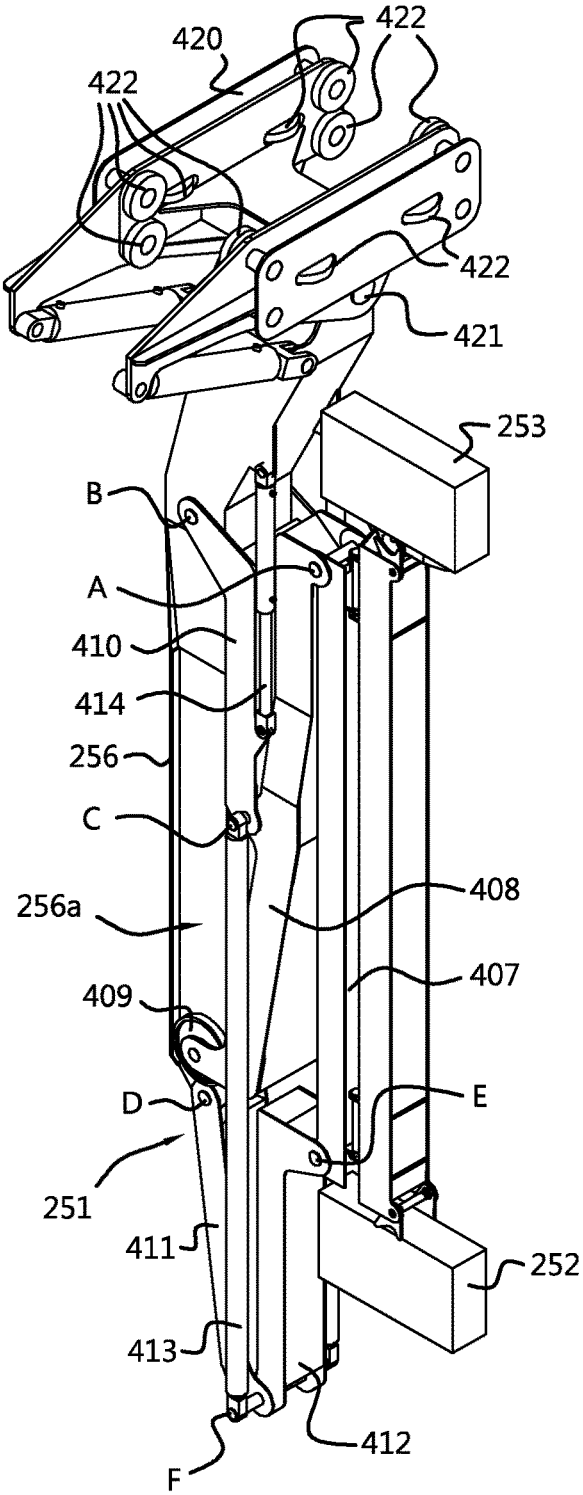
FIGS. 9A-11B depict the racking device of the rig of FIG. 1 in various positions.
Figure 9B:
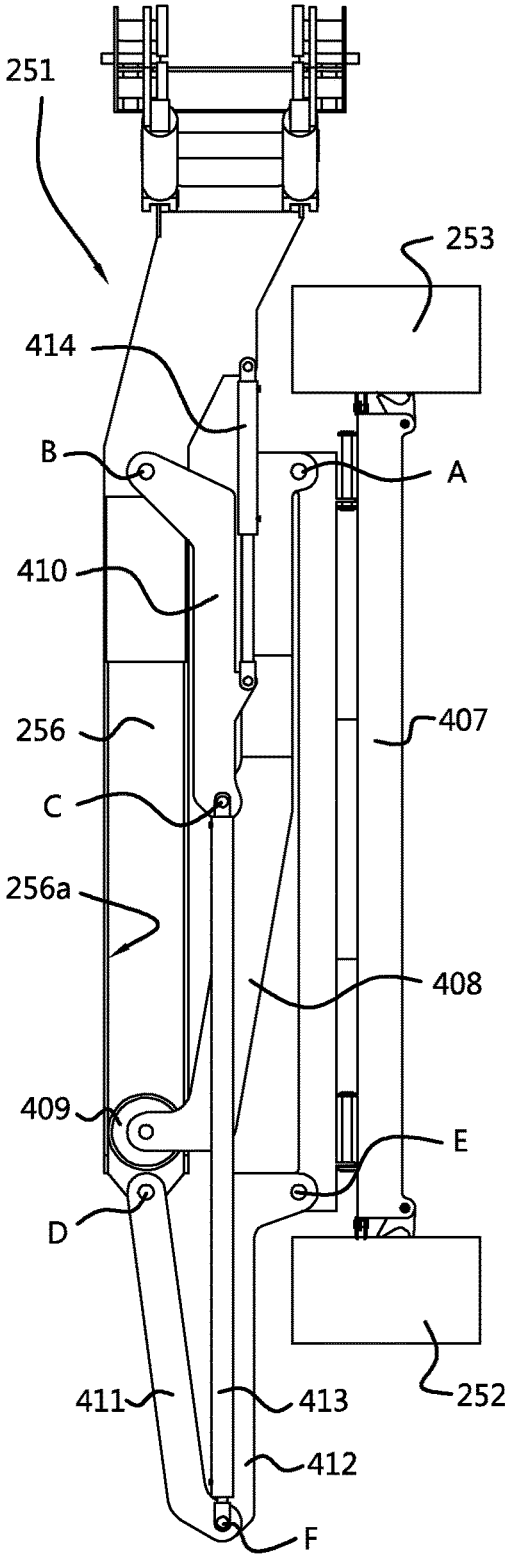
Figure 10A:
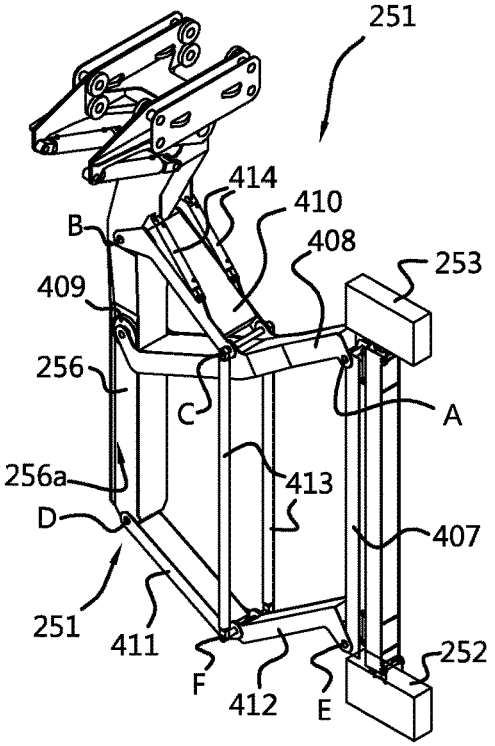
Figure 10B:
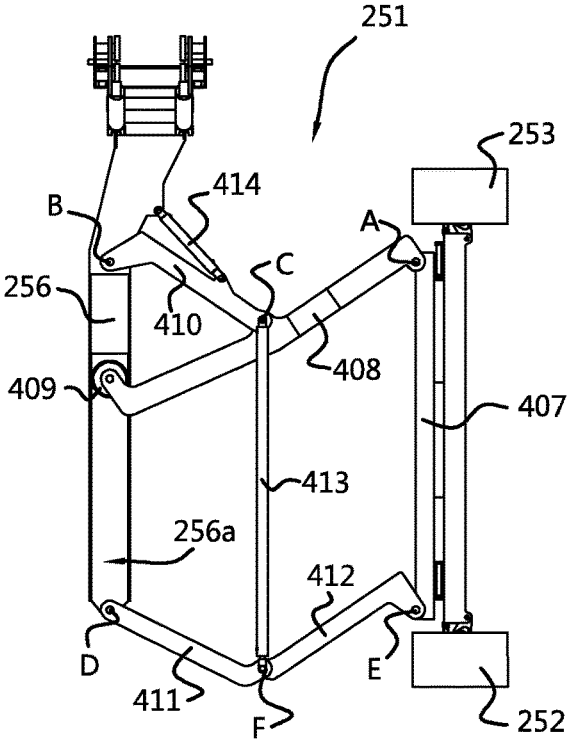

The assembly 251 is further provided with two actuators 414, e.g. hydraulic cylinders, between the vertical carrier beam 256 and the support beam 410 allowing to set an orientation of the support beam 410 relative to the vertical carrier beam 256 thereby allowing to adjust a position of the vertical carrier beam 407 including grippers 252, 253 in a horizontal Y-direction orthogonal to the X-direction between a retracted position as shown in FIGS. 9A, 9B and an extended position as shown in FIGS. 10A, 10B. Preferably, the distance between locations E and F, the distance between locations D and F, the distance between locations A and C, the distance between locations B and C and the distance between location C and the guide wheels 409 are all equal to each other, so that moving in the Y-direction can be done without moving in the Z-direction as well. More preferably, the distance between the location C and the guide wheels 409 is less than half the distance between locations B and D.

Figure 11A:
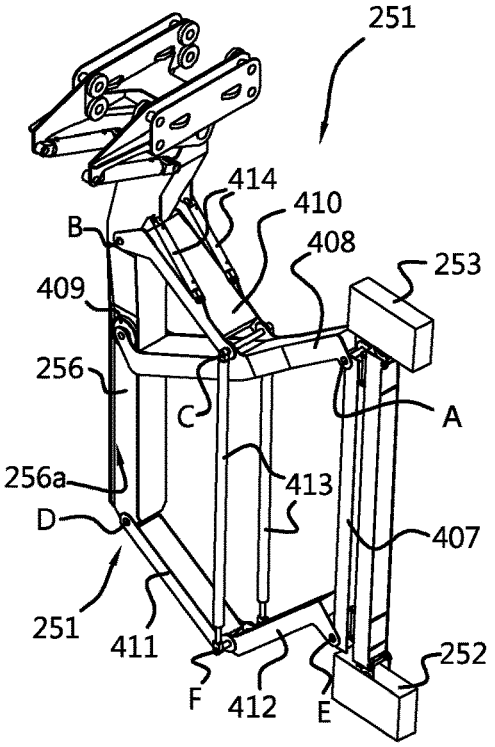
Figure 11B:
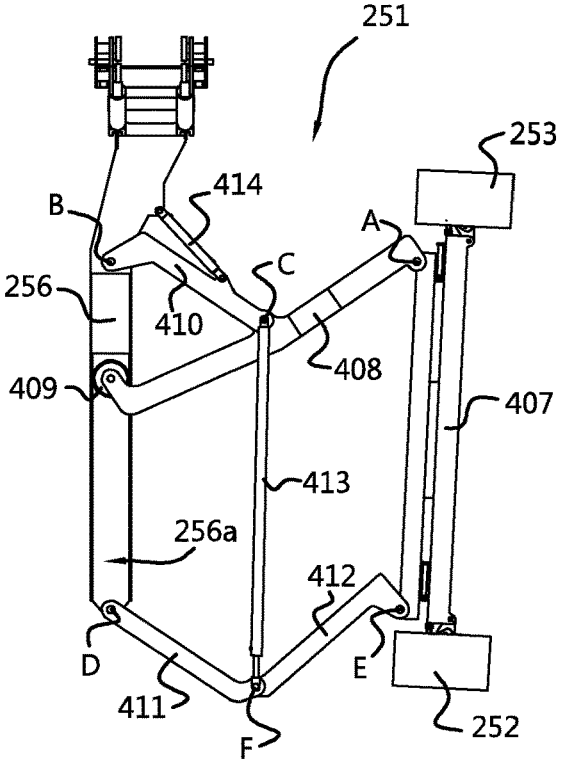

The actuators 413 can be used to tilt the vertical carrier beam 407 relative to the vertical carrier beam 407 as depicted in FIGS. 11A and 11B.

The vertical carrier beam 256 is pivotally connected to cart 420 to pivot about pivot axis 421. The cart 421 is provided with multiple wheels 422 engaging with the rails 254, 255 to guide the assembly 251 along the structural frame 400. Actuators 423, e.g. hydraulic cylinders, have been provided to move the vertical carrier beam 256 including all components connected thereto relative to the cart between an operational vertical position as shown in FIGS. 1-4 and a transport position parallel to the structural frame 400.

Figure 4:
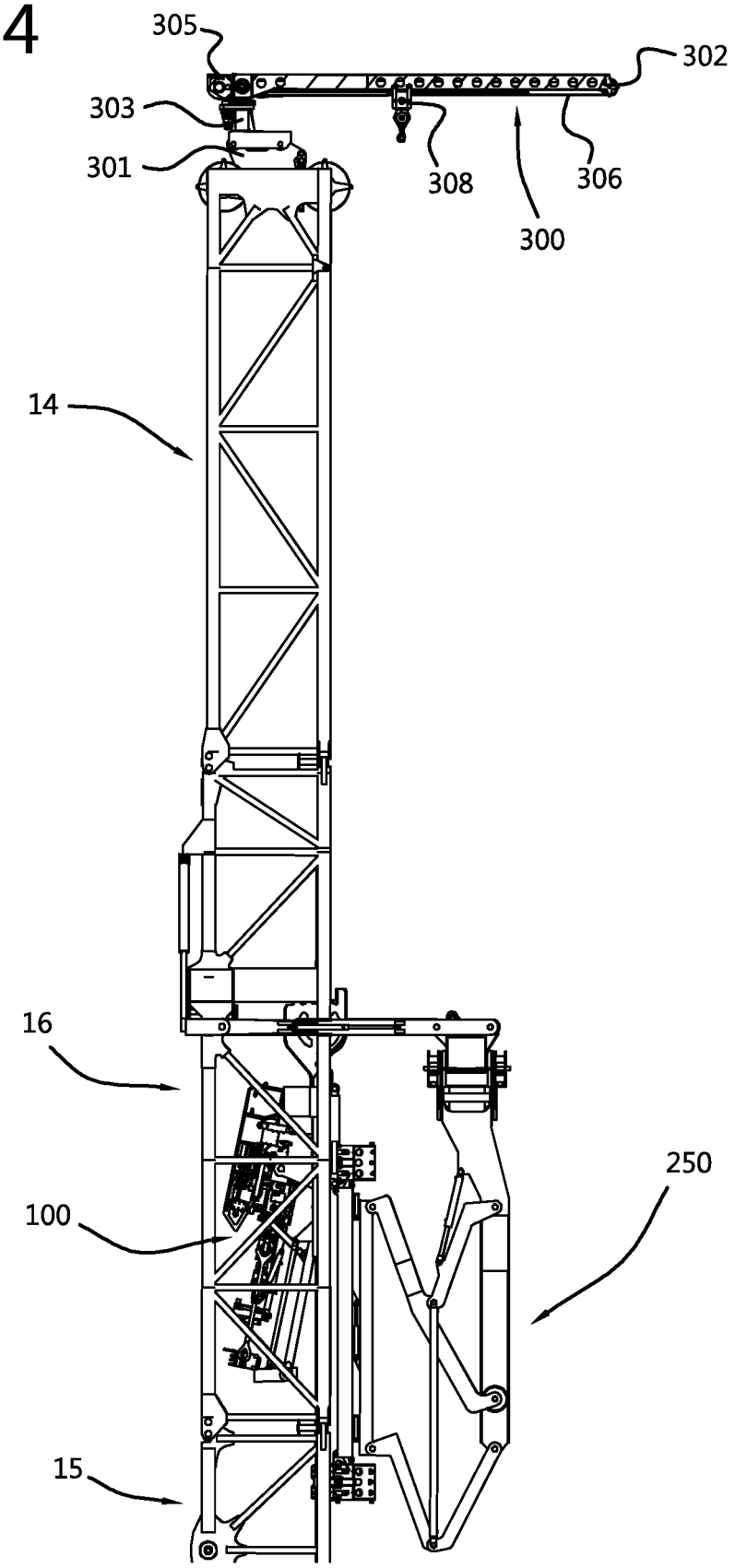
FIG. 4 depicts the part of the rig of FIG. 3 in side view.

FIGS. 3 and 4 illustrate that the tower, here the U-shaped horizontal cross section mast 10, is provided at the top thereof with an auxiliary crane 300 having a base 301 secured to the tower and a crane boom 302 connected via a vertical axis slew bearing 303 to the base 301 allowing to slew the boom, e.g. about a full revolution.

The auxiliary crane 300 comprises a winch 305 and a winch driven cable 306 for hoisting of objects. The auxiliary crane is embodied such that the winch driven cable 306 can be passed vertically along the firing line 23 down to the well center 21 in the tripping mode of the top drive system 110 so as to allow for use of the auxiliary crane 300 for lifting operations at or near, or towards and away from, the well center 21.

Here it is shown that the auxiliary crane 300 is a jib or cantilever crane, wherein the boom 302 extends permanent in horizontal direction and wherein a trolley 308 is displaceable along the boom, with the trolley being provided with a sheave. The trolley 308 is at least positionable so that the winch driven cable 306 passing over the sheave is aligned with the firing line, and a position remote from said firing line position. The trolley could also support a winch with a winch driven cable.

With reference to the FIGS. 12-21, a method for use of the drilling rig of FIG. 1 will be described, in particular a method for tripping out a drilling tubulars string from a wellbore.

Figure 12:
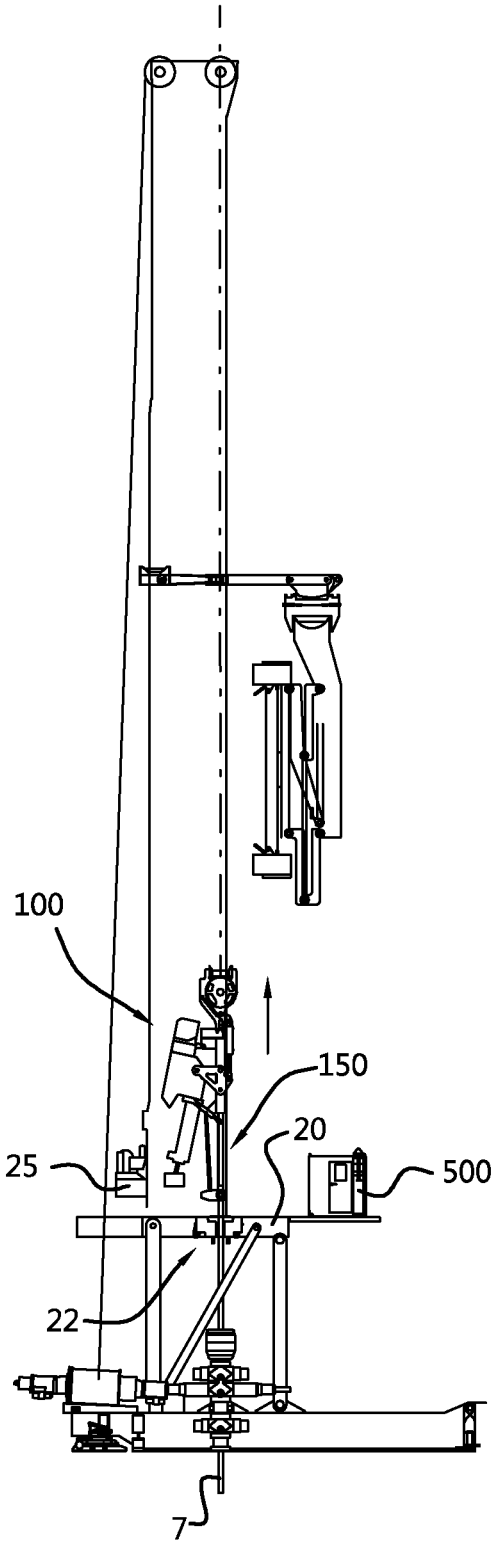
FIGS. 12-21 illustrate a tripping sequence of a drill string by means of the rig of FIG. 1.

In FIG. 12 a situation is depicted wherein a drilling tubulars string 7 is suspended in the wellbore by means of the slip device 22. A top end of the string 7 sticks out above the slip device, which top end (as is common in the field) is provided with an enlarged diameter connector, e.g. a threaded connector, e.g. a threaded box end.

The top drive system 100 is in the described tripping mode as shown in FIGS. 6A, 6B and the traveling carriage 110 has been lowered to bring the tripping operation elevator 150 at an initial engagement level, wherein the tripping operation elevator 150 is connected with the top end of the suspended string 7.

Figure 13:
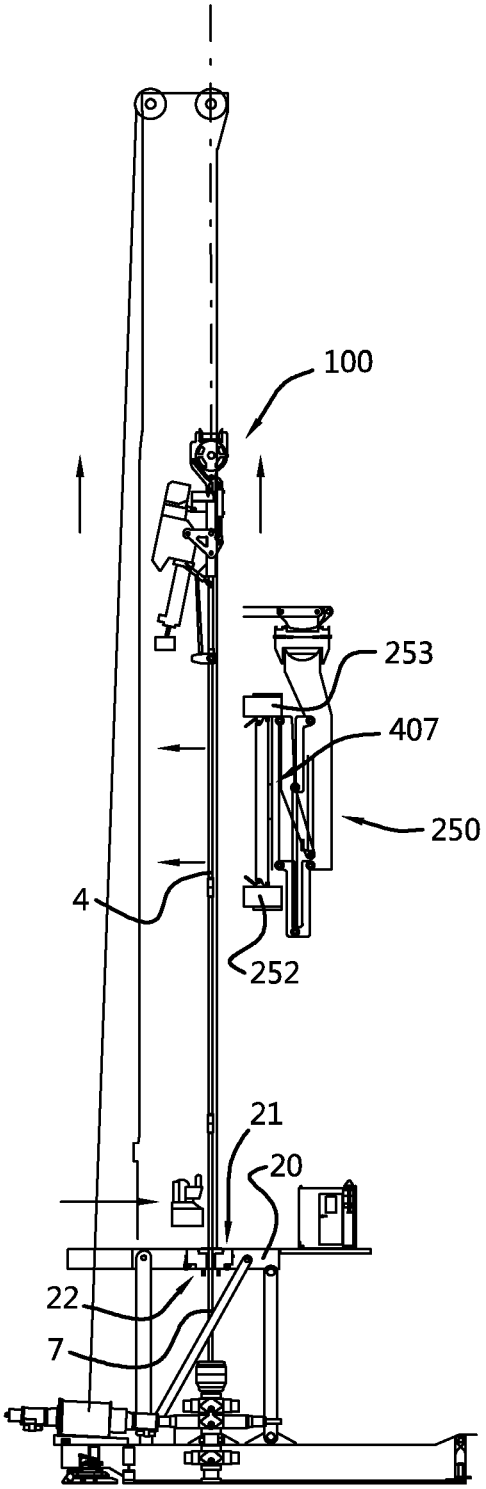

As illustrated in FIG. 13, for tripping out, the slip device 22 has released the string 7 and the carriage 110 is lifted, so as to pull up a tubulars stand 4 above the well center 21 by means of the elevator 150. In this example a triple length stand 4 is pulled up, but this could also be a double stand 4 or some other number of tubulars forming the stand 4.

It is noted that during tripping out, the vertical carrier beam 407 including the grippers 252, 253 of the pipe racking device 250 is in the retracted position away from the stand 4 and thus does not interfere with the tripping out of the stand 4.

Figure 14:
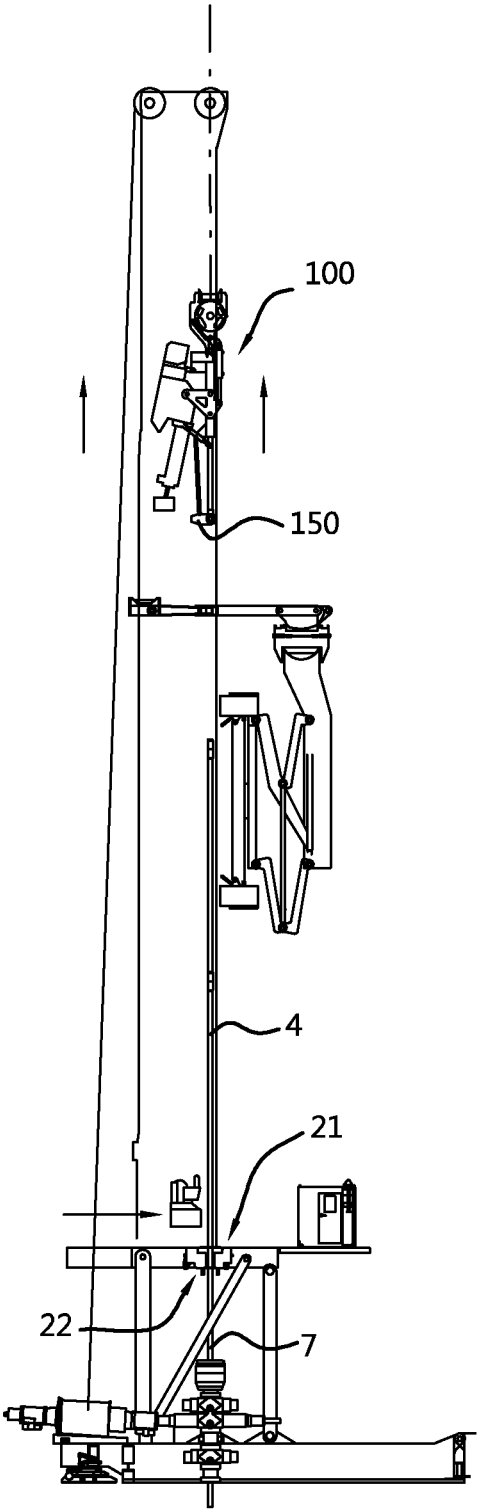

In FIG. 14, the entire triple stand 4 has been pulled up above the well center 21 by means of the elevator 150 and the slip device 22 is now operated to reengage on the string 7, below the stand 4, so that the string 7, still including the connected stand 4, is vertically retained.

Figure 15:
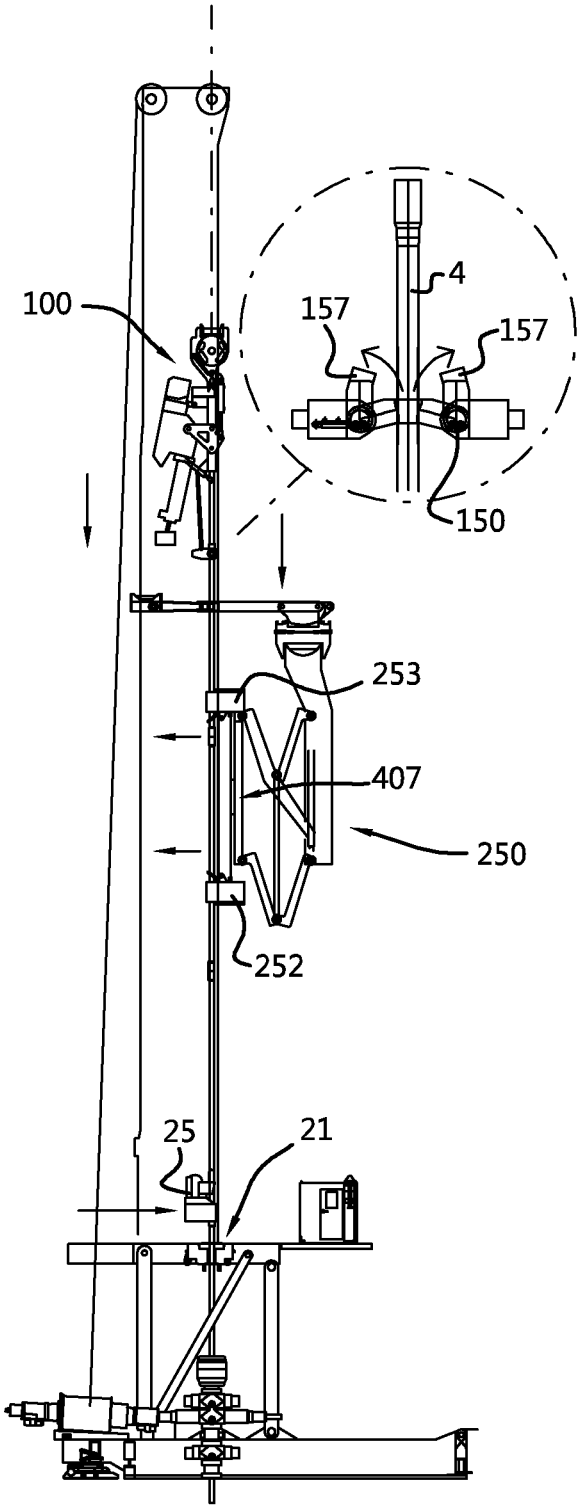

In FIG. 15, both of the grippers 252, 253 of the racking device 250 engage with the stand 4, e.g. the grippers 252, 253 already encircling and/or gripping the stand 4 prior to the actual disconnection. Further, the tripping operation elevator 50 is slid down along the stand 4 to disengage with the top end of the stand 4 and to allow the elevator to be opened by moving the locking members 157 to the upright position as shown in the detail of FIG. 15.

Also shown in FIG. 15 is that the tubulars connection makeup and breaking device 25 is advanced from a parking position as shown in FIG. 12 to a well center position as shown in FIG. 15 in order to be operated to break up the connection between the stand 4 and the rest of the drill string suspended by the slip device 22.

Figure 8A:
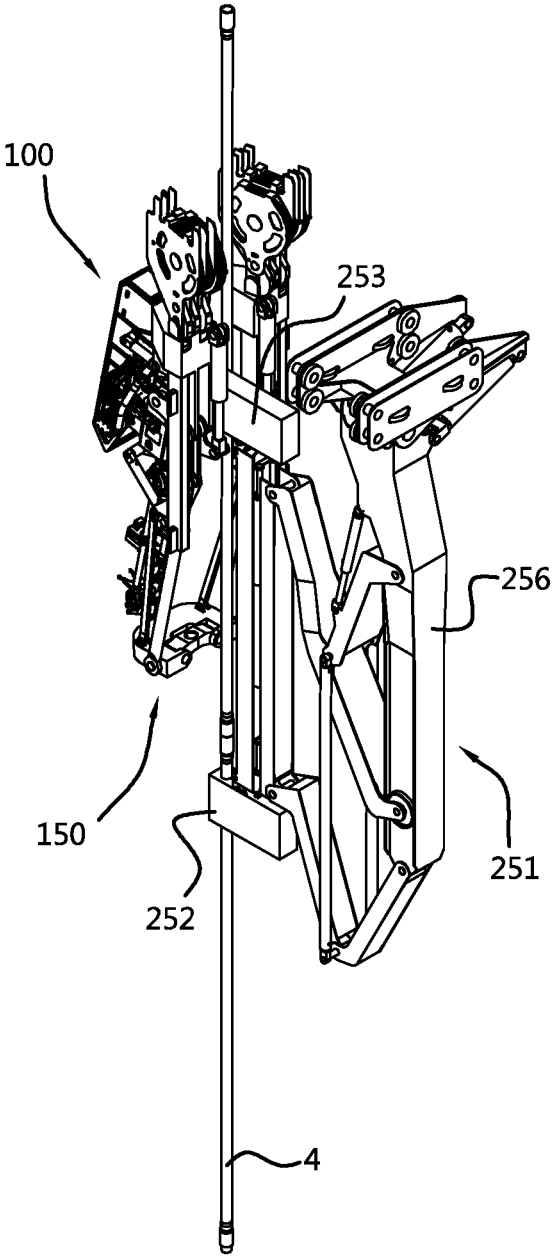
FIGS. 8A-B depict the top drive system of the rig of FIG. 1 while passing the racking device.
Figure 8B:
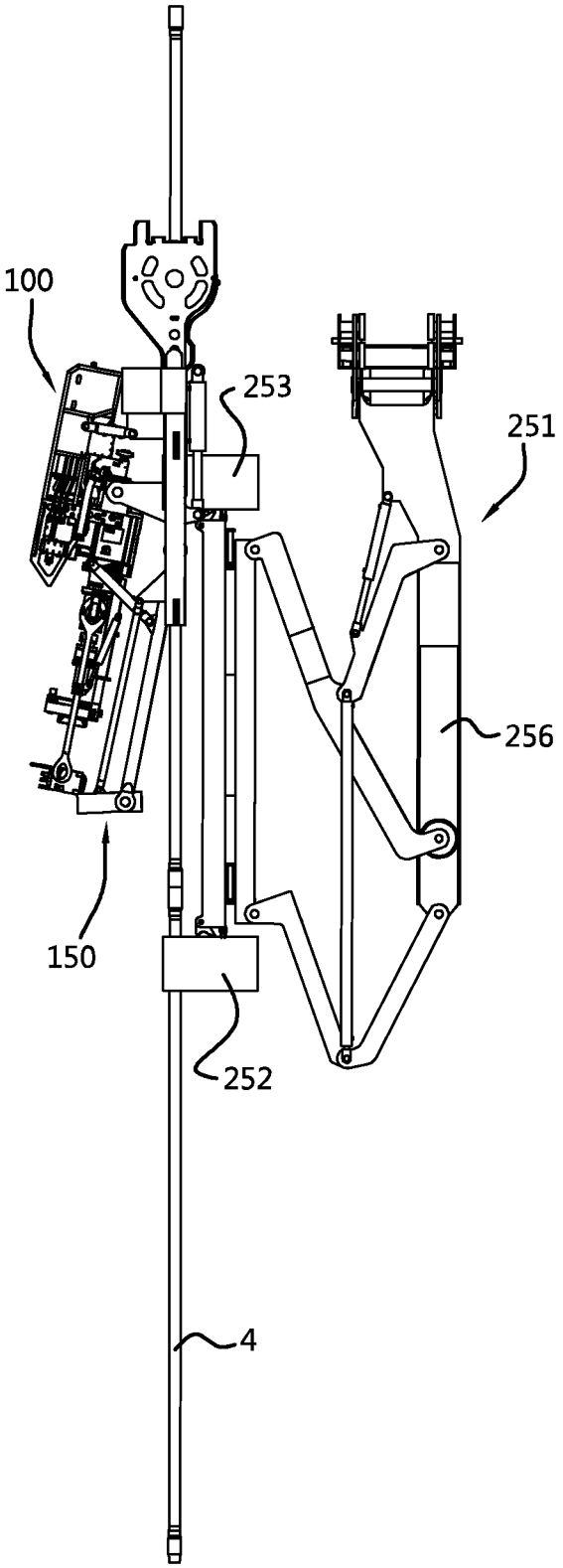
Figure 16:
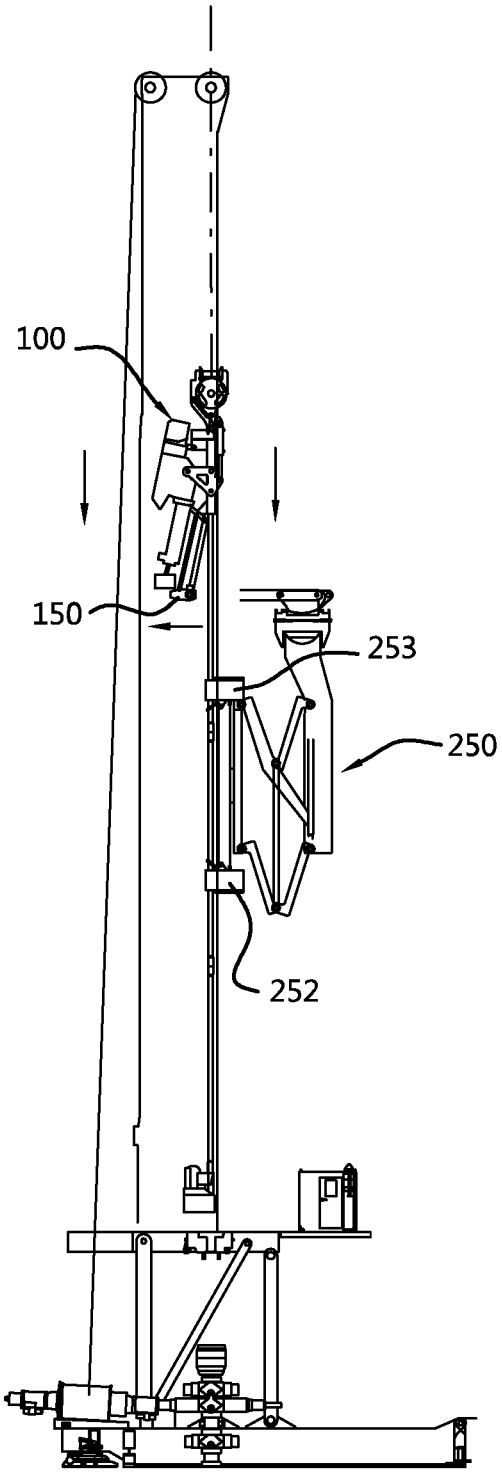
Figure 17:
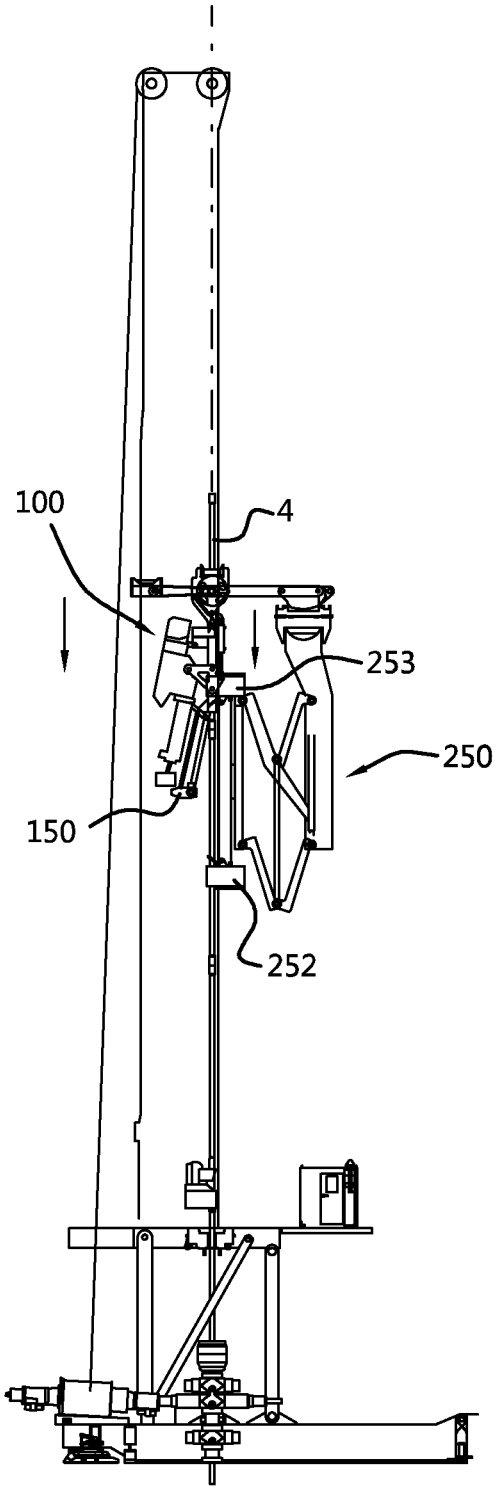
Figure 18:
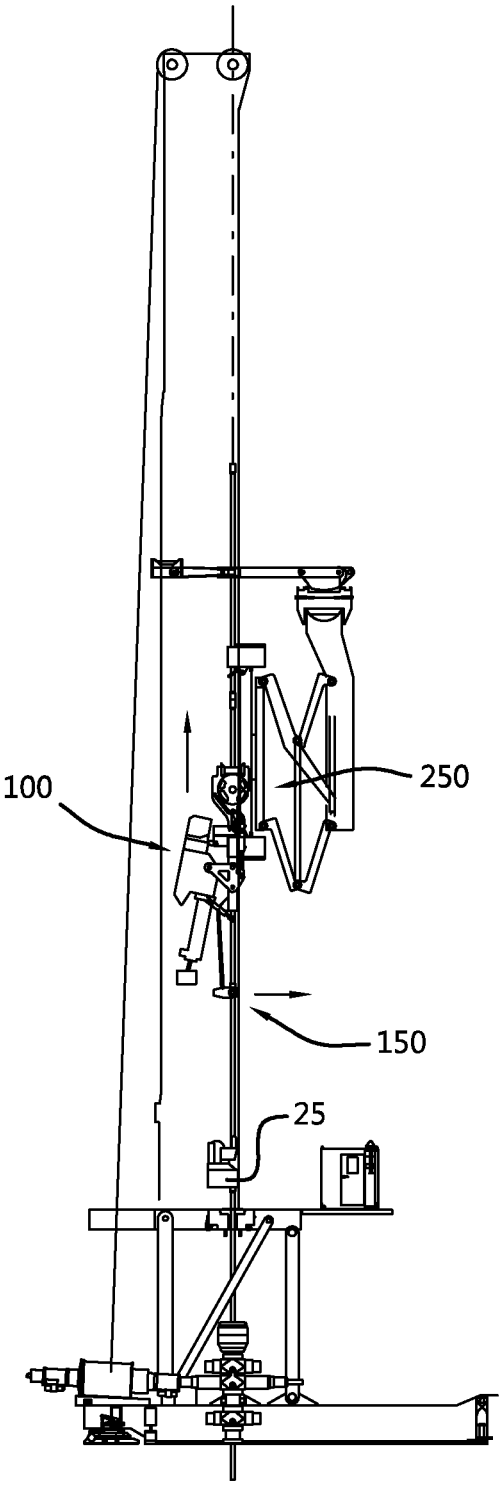

FIGS. 16-18 depict various stages in the lowering of the carriage 110 towards the initial engagement level of the tripping operation elevator 150. In FIG. 16, the top drive system 100 is still above the grippers 252, 253 of the racking device 250 and the grippers 252, 253 already engage on the stand 4. To pass the location where the racking device engages on the stand 4, the top drive system is put in the bypassing mode with the elevator 150 in a retracted position as shown in FIGS. 5A and 5B in which both the top drive unit and the tripping operation elevator 150 are cleared from the firing line to such an extent that, with the tubulars racking device engaging on the stand 4 held by the slip device in the firing line above the well center, the top drive system is able to pass the location where the tubulars racking device engages on the stand 4 as depicted in FIG. 17. The situation in FIG. 17 is depicted in more detail in FIGS. 8A and 8B only depicting the top drive system 100 while passing the assembly 251 which engages on the stand 4.

In FIG. 18, the top drive system 100 has passed the location where the racking device engages on the stand 4, so that the top drive system can be brought back into the tripping mode with the elevator 150 in the operational position thereof as also shown in FIGS. 6A, 6B.

Figure 19:
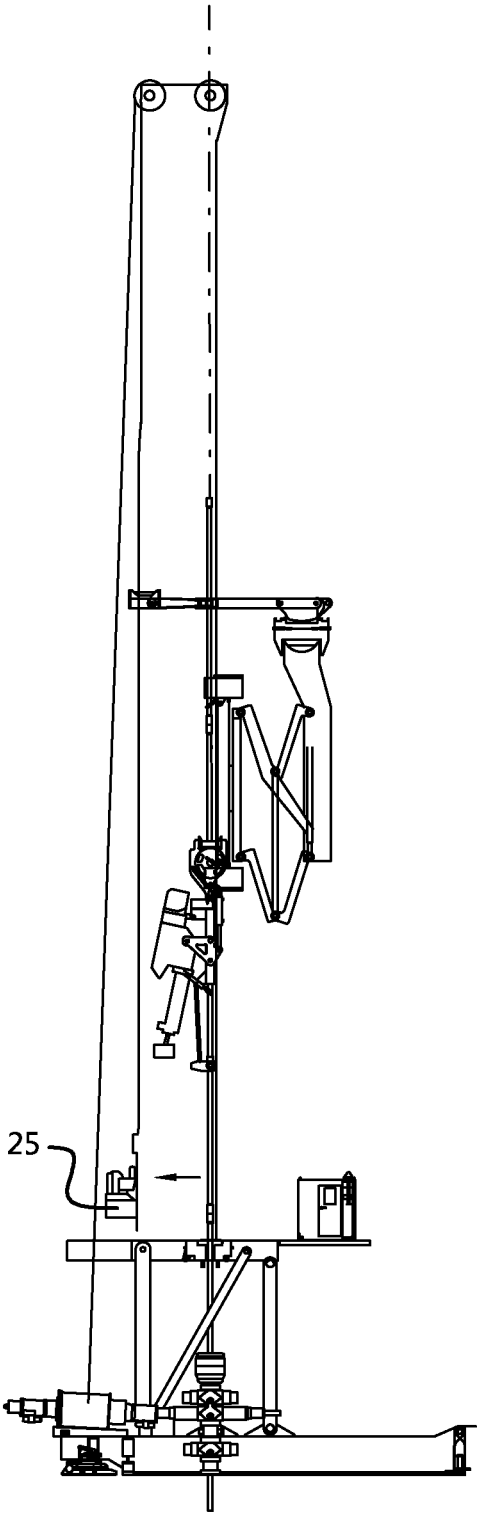

During lowering of the top drive system, the device 25 is operated to break up the connection between the stand 4 and the rest of the drill string. In FIG. 19, the device 25 is moved back to the parking position before the carriage of the top drive system reaches a position corresponding to the initial engagement level of the tripping operation elevator 150.

Figure 20:
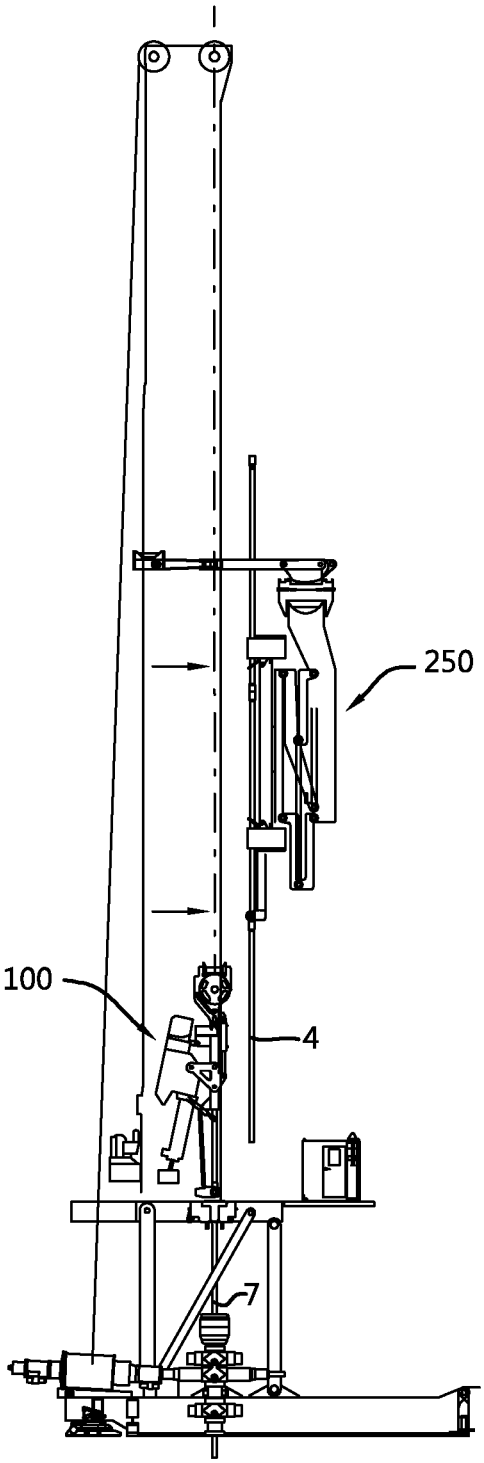

In FIG. 20, the gripped stand 4 may be raised to complete the disconnection and allow for the racking device to move the stand laterally, e.g. in forward direction, out of the elevator 150 and to store the stand in a fingerboard 71, 72. Due to the locking members 157 being in the upright position, i.e. the clearance position, there is enough clearance for the stand to be moved out of the elevator 150.

Figure 21:
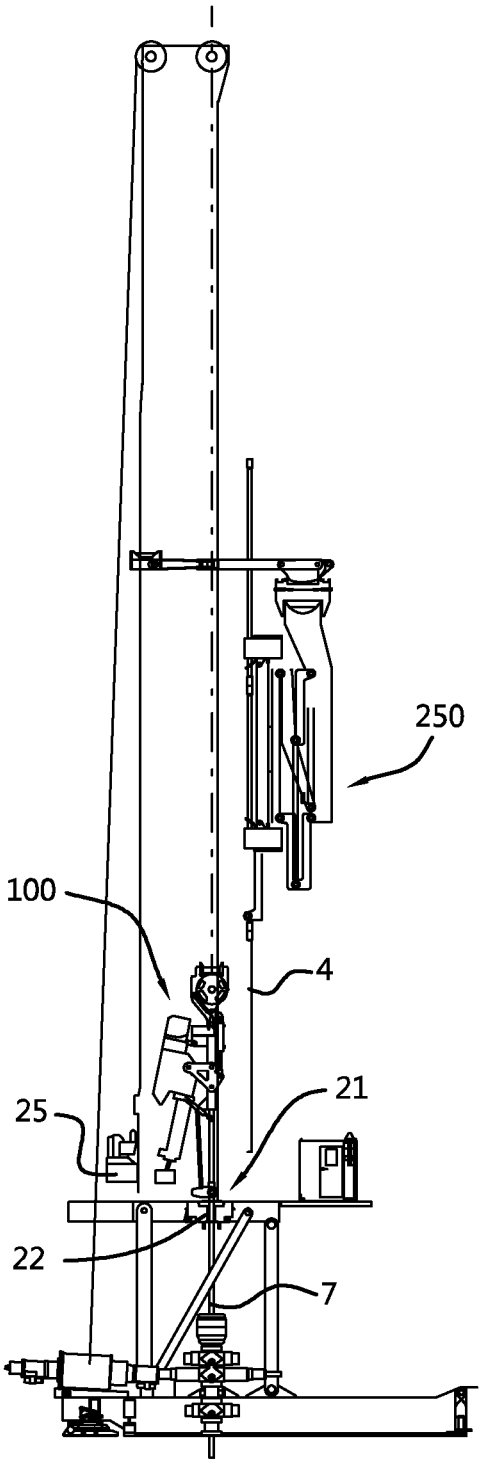

The descent of the carriage 110 is preferably done without pausing, and finally the elevator—with the stand 4 being removed from the firing line—reaches the top end of the suspended 7 and engages therewith, e.g. by closing the locking members 157 as shown in FIG. 21, so as to allow for the lifting of a next stand above the well center 21.

An advantage of the described sequence is that the racking device is able to grip the stand 4 without having to wait for the top drive system to be lowered past the racking device. Hence, disconnecting the stand 4 can be started earlier resulting in a reduction of time for the tripping process.

As will be appreciated the operations of the devices employed therein may all be coordinated by one suitably programmed computerized controller, so that the entire tripping process or at least a significant part of the string tripping, may be done in automated manner, e.g. under supervision of one or more operators in an operator cabin 500, e.g. with a view on the front side of the mast. Hence, preferably all equipment involved in the tripping operation as discussed is connected to a central computerized control unit that is programmed to perform the tripping operation, at least of a major part of the drilling tubulars string 7, fully automated. It is envisaged that in such fully automated tripping sequence one or more operators in an operator cabin 500 merely serve to supervise the process and respond in case of anomalies. In a semi-automated sequence some commands may be given via one or more input devices by the one or more operators, these commands starting parts of the sequence.

It will be appreciated that tripping out is done fast as at least one of the following steps is performed in time overlap with the lowering of the carriage 110:

disconnecting the lifted tubulars stand 4 from the suspended drill string by means of the tubulars connection makeup and breaking device 25 near the well center, removing the disconnected tubulars stand 4 from the firing line, primarily in lateral direction, here by means of the racking device 250, placing the drilling tubulars stand in said fingerboard device, here by means of the racking device 250.

For example, as soon as the elevator 150 has lifted the stand 4, the grippers can be made to grip the stand 4 and the device 25 can be operated to disconnect the stand 4 by breaking the lower connection thereof. As soon as the disconnect is brought about, preferably with the elevator 150 still descending, the racking device is operated to move the stand away from the firing line 23. The latter may involve remote control operation of the one or more locking members 157 to allow the stand to be moved laterally out of the still descending elevator. The racking device 250 can then continue to place the stand 4 in a fingerboard 71, 72 and the elevator can be lowered over the top end of the next stand to be pulled out.

The skilled person will appreciate that the described drilling rig also allows for efficient and fast tripping in, which is basically done in reverse order of tripping out.

With reference to the FIGS. 22 to 33, another method for use of the drilling rig of FIG. 1 will be described, in particular a method for drilling a drilling tubulars string into a wellbore.

In FIG. 22*a* situation is depicted wherein a drilling tubulars string 7 is suspended in the wellbore by means of the slip device 22. The string 7 extends to above the racking device 250. A top end portion of the string 7, which commonly is provided with an enlarged diameter connector, is engaged by the top drive unit of the top drive system 100, which top drive system is in the wellbore drilling mode as depicted in FIGS. 7A, 7B in which the rotary torque output member is aligned with the firing line 23 and the elevators 150, 160 are in a non-operational position away from the firing line.

Figure 23:
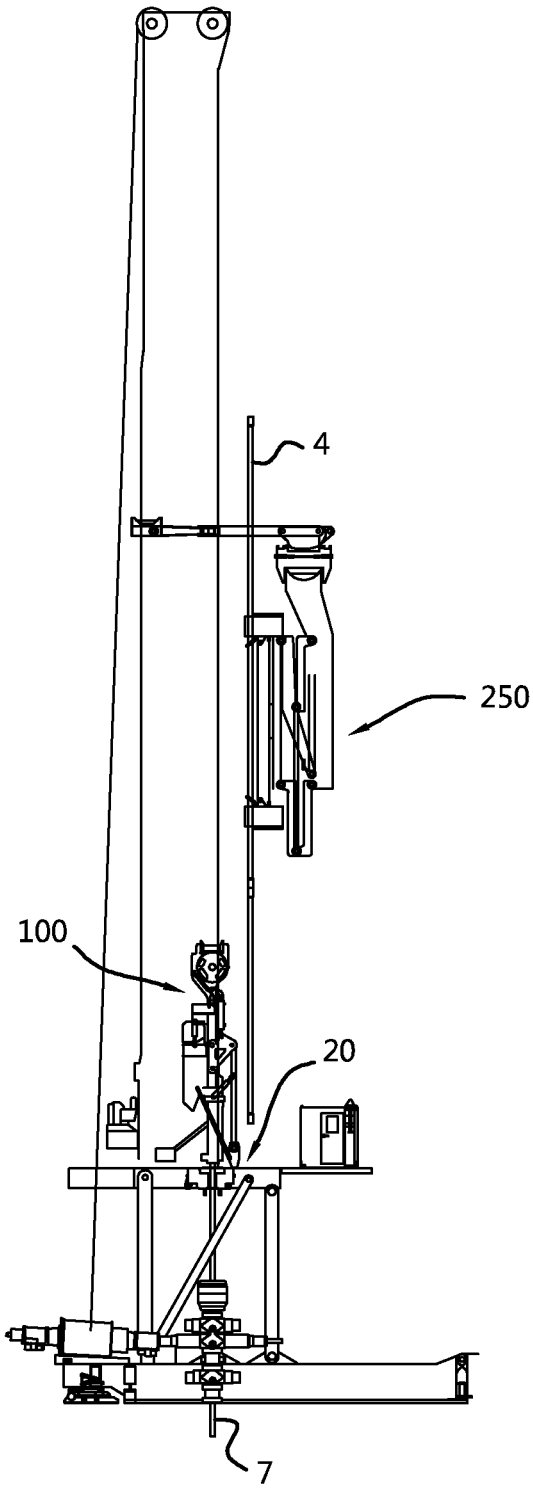

The slip device 22 is released and subsequently, the top drive unit is operated to impart a torque to the string 7 in order to perform drilling operations. During these drilling operations, the string 7 and thus the top drive system is lowered to just above the drill floor 20 as depicted in FIG. 23, i.e. in close proximity of the drill floor. In the meantime, the racking device 250 has obtained a drilling tubulars stand 4 from one of the fingerboard devices 71, 72.

Figure 24:
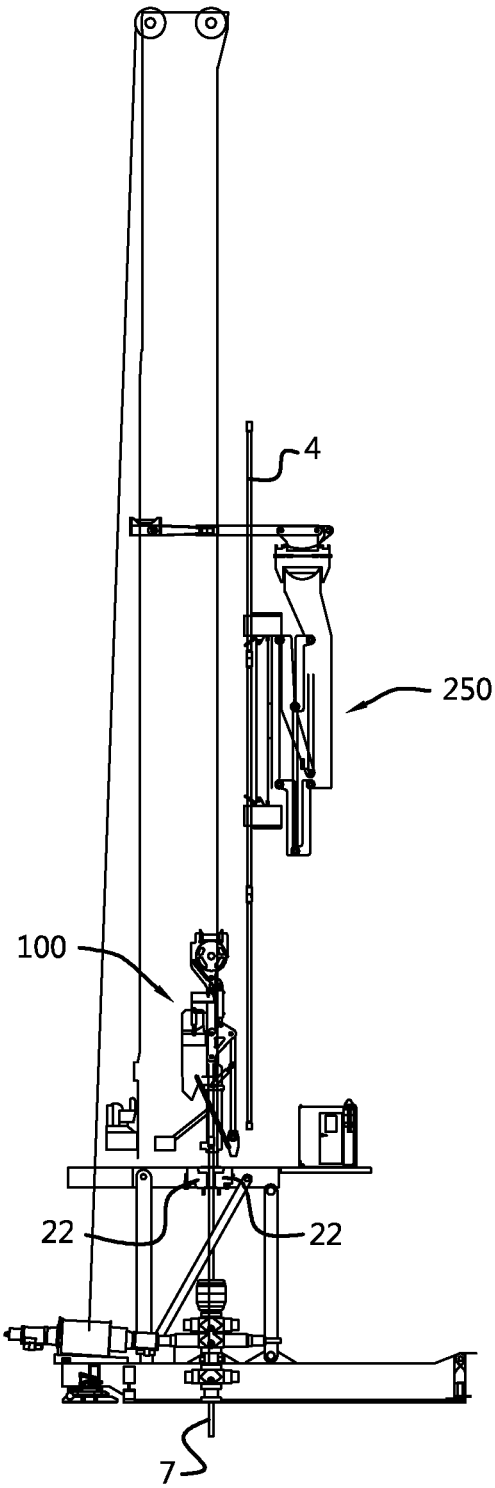
Figure 25:
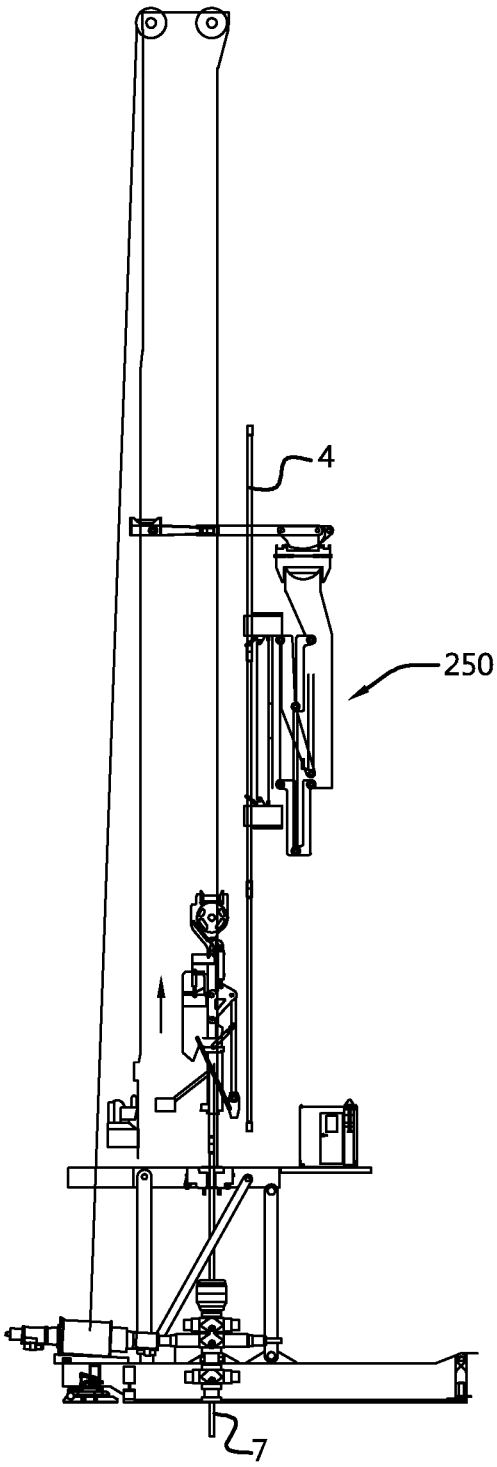

To release some of the tension build up in the string 7 during drilling, the top drive system 100 is retracted over a predetermined distance to a predetermined level, e.g. corresponding to the initial engagement level mentioned in relation to the tripping process, to allow the slip device to reengage with the string 7. This is depicted in FIG. 24. The top drive system 100 is then disengaged from the top end portion of the string 7 and starts is ascend to above the racking device 250 as shown in FIG. 25.

Figure 26:
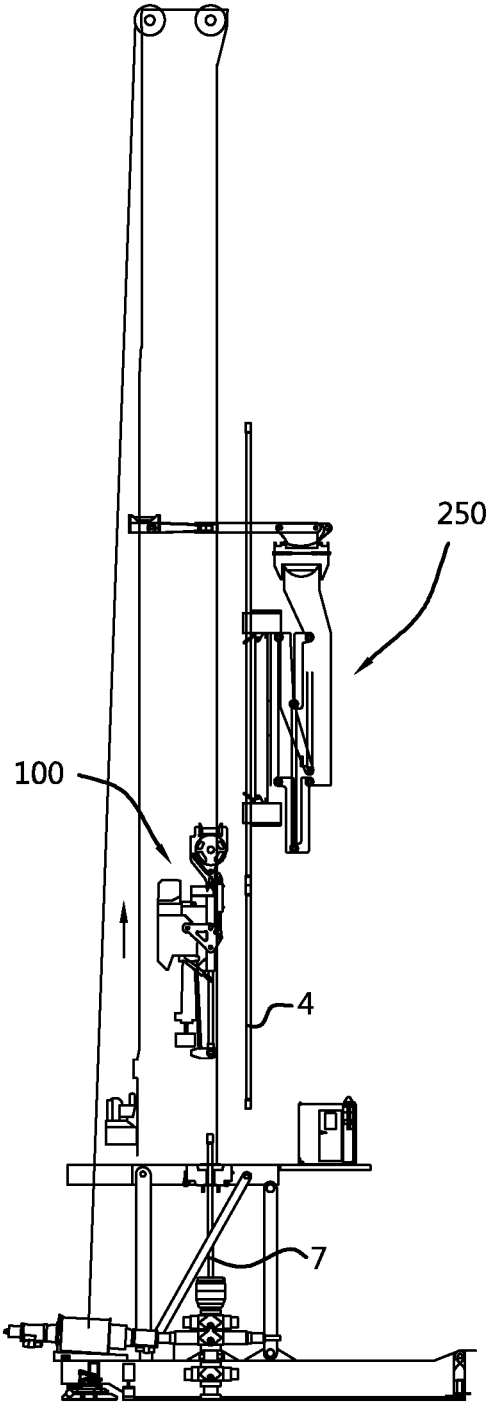
Figure 27:
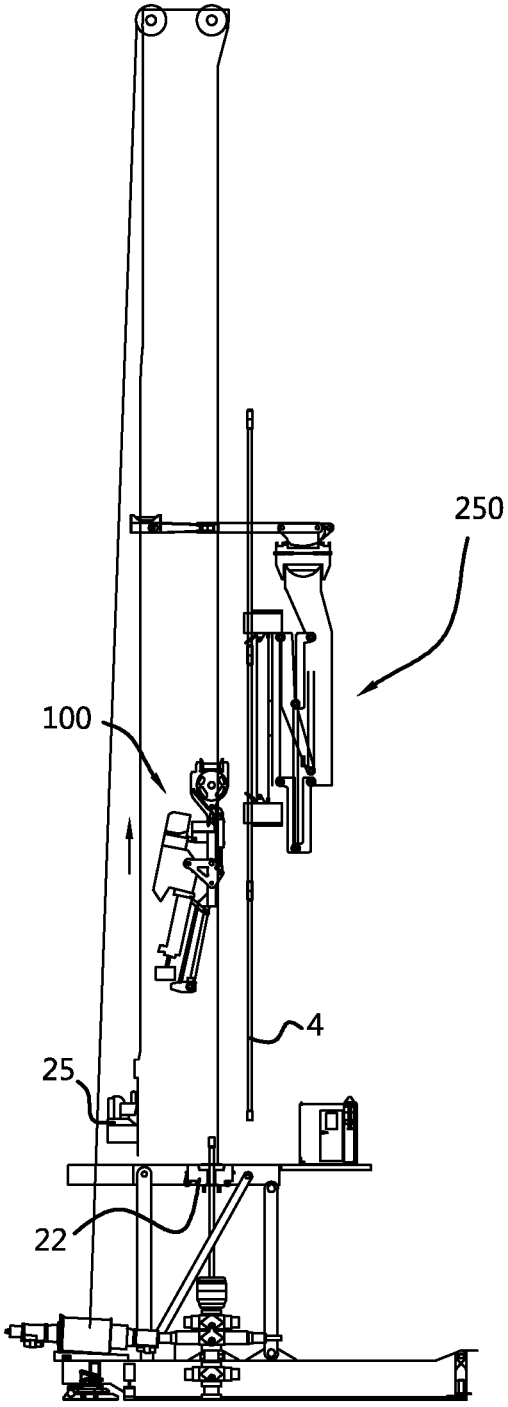
Figure 28:
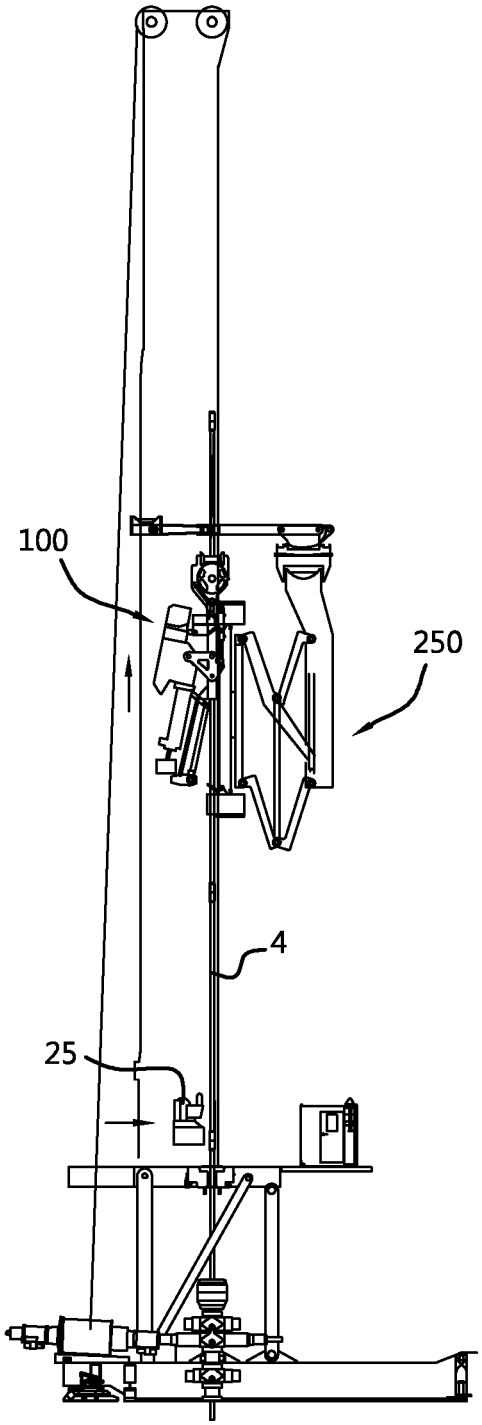
Figure 29:
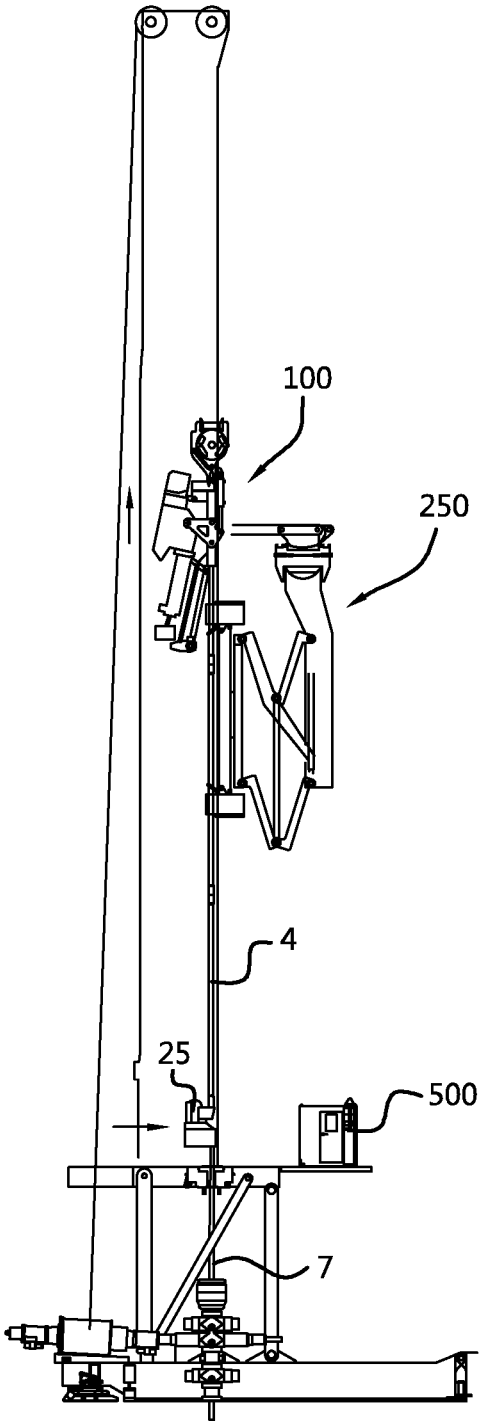

In FIG. 26, while the top drive system is raised, the top drive system is brought first into the tripping mode in which the top drive unit is moved to the retracted position and the tripping operation elevator is moved to the operational position. Subsequently as depicted in FIG. 27, the top drive system is brought into the bypassing mode allowing to pass the racking device 250 while the racking device positions the stand 4 in the firing line 23 which is depicted in FIG. 28. Once the stand 4 is positioned in the firing line 23, the device 25 can be moved from the parking position to the well center position in order to connect the stand 4 to the string 7 as shown in FIG. 29.

Figure 22:
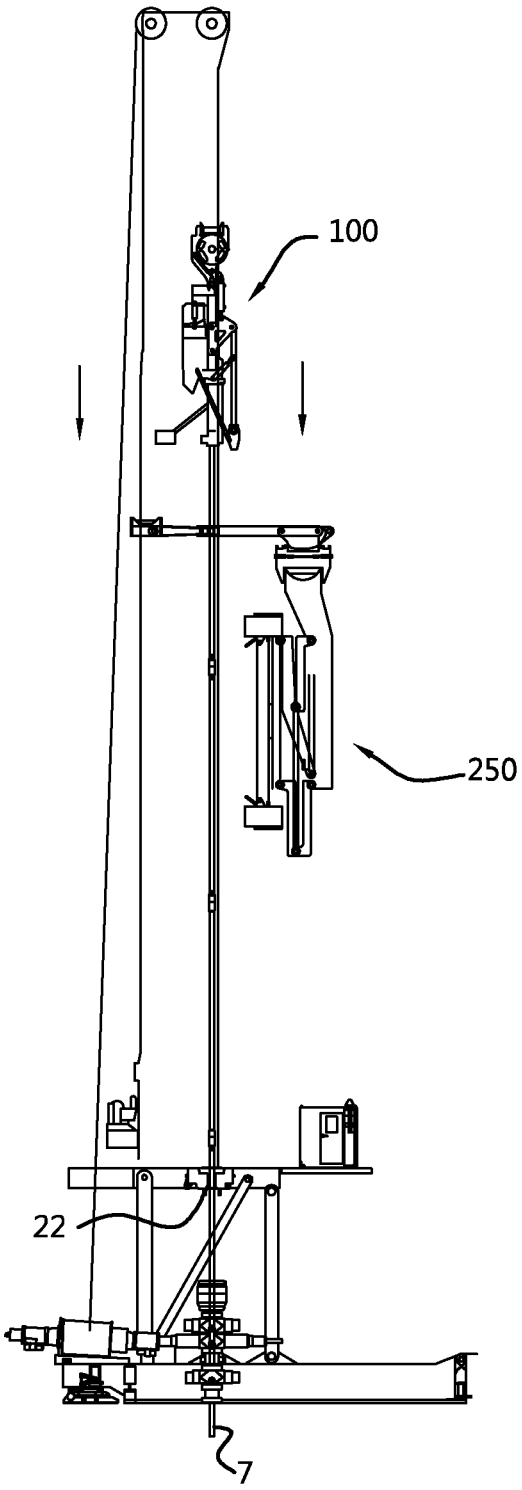
FIGS. 22-33 illustrate a drilling sequence of a drill string by means of the rig of FIG. 1.
Figure 30:
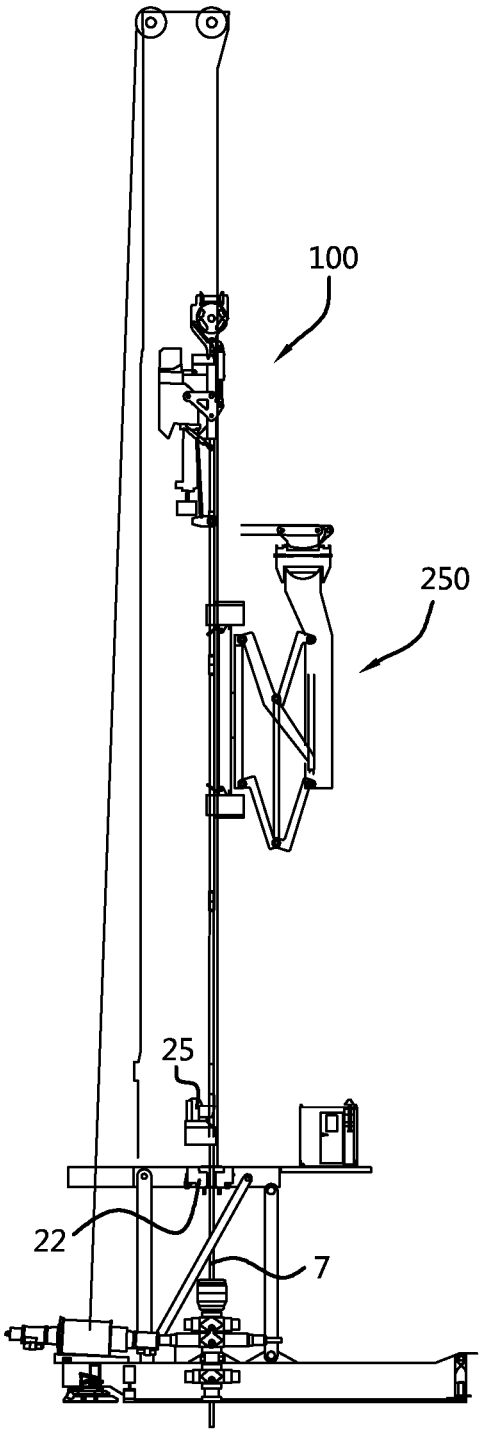
Figure 31:
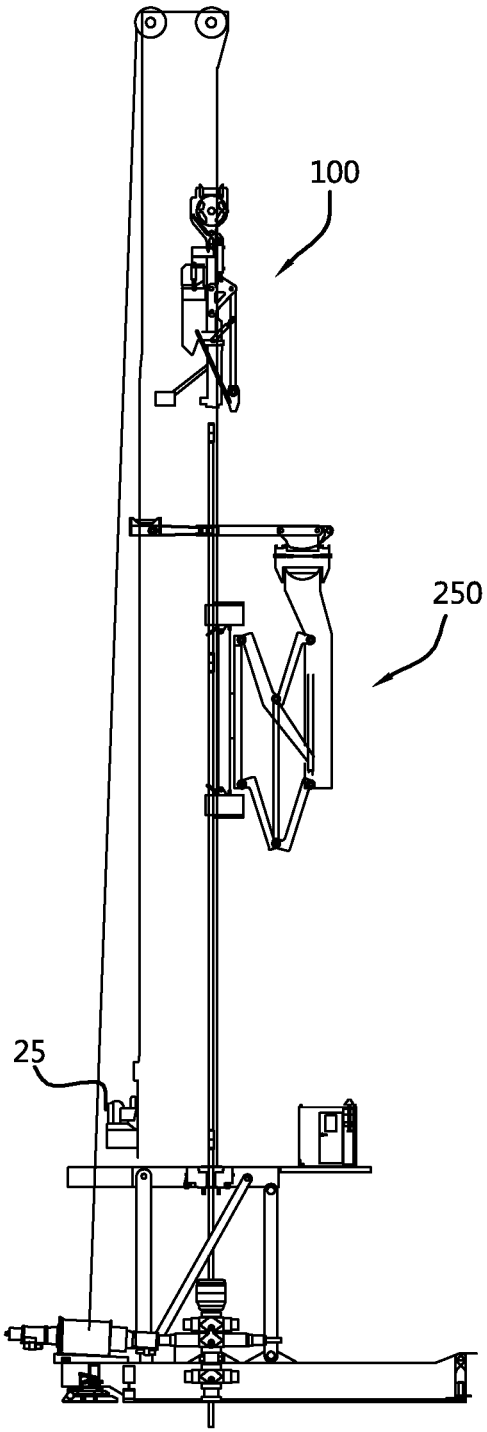
Figure 32:
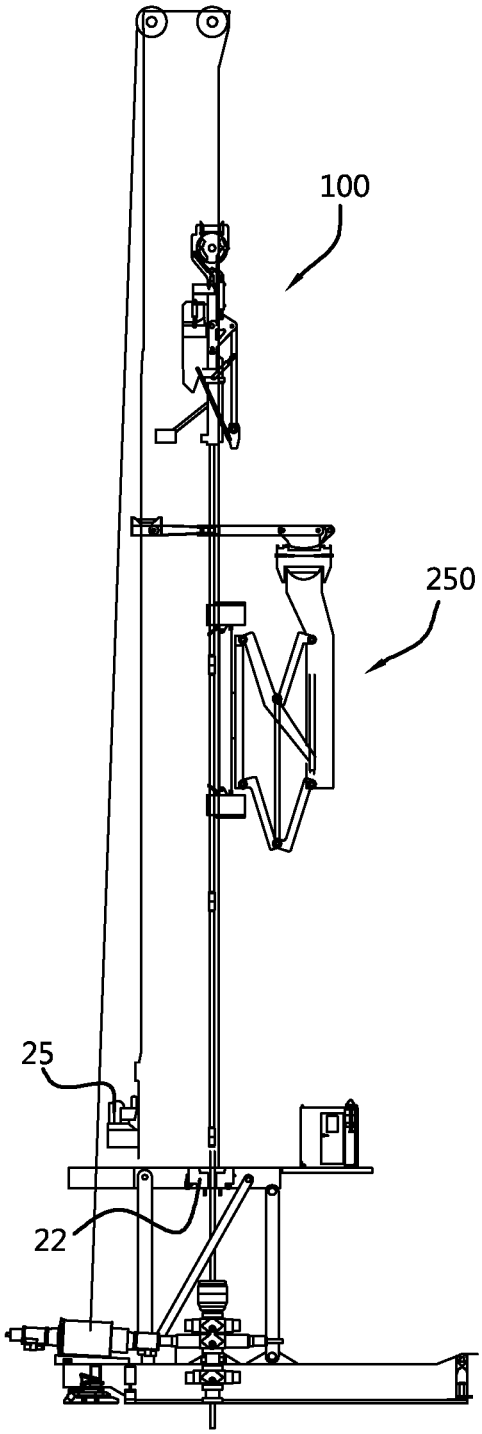
Figure 33:
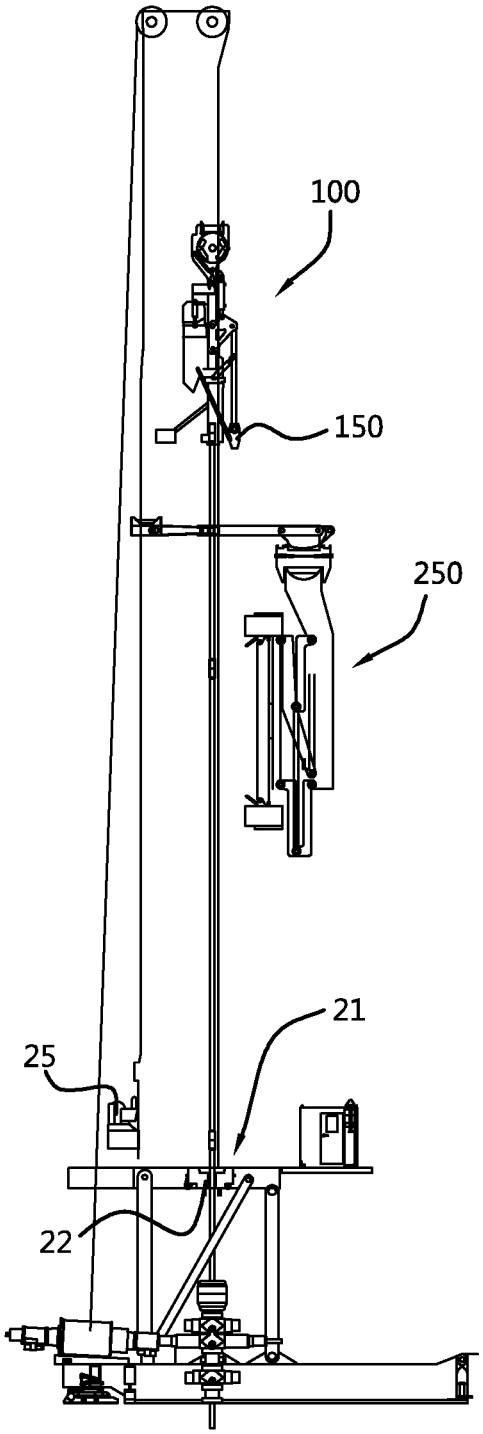

In FIG. 30, the top drive system 100 has passed the racking device and can be brought back to the wellbore drilling mode (shown in FIG. 31) via the tripping mode as depicted in FIG. 30. In FIG. 32, the top drive unit is connected to the top end portion of the string 7 and the device 25 is moved back to the parking position. In FIG. 33, the racking device has disengaged from the string 7 resulting in a similar situation as depicted in FIG. 22.

The invention claimed is:

1. A drilling rig adapted to perform drilling and/or other wellbore related activities, the drilling rig comprising:

a drilling tower;

a drill floor with a well center positionable above a wellbore;

a slip device adapted to suspend a drilling tubulars string in the wellbore;

a top drive system;

a vertical motion drive adapted to cause a vertical motion of the top drive system relative to the drilling tower in order to perform drilling and tripping operations; and a fingerboard device adapted to store drilling tubular stands, wherein the drilling tower is provided with one or more vertical rails parallel to a vertical firing line that extends through the well center, wherein the drilling rig further comprises a tubulars racking device comprising one or more mobile tubulars gripper assemblies with one or more grippers adapted to grip a drilling tubular or drilling tubulars stand and to move the drilling tubular or drilling tubulars stand between the fingerboard device and the firing line, wherein the top drive system comprises:

a traveling carriage that is vertically mobile along said one or more vertical rails of the drilling tower by means of said vertical motion drive; and a top drive unit supported by said traveling carriage and comprising a top drive motor and a rotary torque output member that is adapted to be engaged with a top end of a drilling tubulars string extending in the firing line through the well center to impart torque to said drilling tubulars string in order to perform drilling or other wellbore related operations, wherein the top drive system comprises a tripping operation elevator that is adapted to be engaged with a drilling tubulars string or drilling tubulars stand in order to perform tripping operations, wherein the top drive unit and the tripping operation elevator are mobile relative to the carriage, and wherein the top drive system is provided with an actuator assembly adapted to cause said relative motion of the top drive unit and of the tripping operation elevator so as to provide:

a wellbore drilling mode;

a tripping mode; and a bypassing mode, wherein the top drive unit is moveable by said actuator assembly between an operative position, in which the rotary torque output member is aligned with the firing line, and a retracted position, in which the rotary torque output member is away from the firing line, wherein the tripping operation elevator is moveable by said actuator assembly between an operative position, in which the tripping operation elevator is aligned with the firing line, and a non-operative position, in which the tripping operation elevator is away from the firing line, wherein, in the wellbore drilling mode, the top drive unit is positioned in the operative position of the top drive unit and the tripping operation elevator is positioned in the non-operative position, wherein, in the tripping mode, the top drive unit is positioned in the retracted position and the tripping operation elevator is positioned in the operative position of the tripping operation elevator, such that an unobstructed zone is present vertically above the tripping operation elevator allowing the top drive system to be lowered along a drilling tubulars stand held by the slip device in the firing line above the well center, at least until the top drive system has passed below a top end of said drilling tubulars stand, wherein the top drive system is embodied such that when the top drive system is lowered at least below the top end of said drilling tubulars stand, said drilling tubulars stand is removable from the firing line, primarily in lateral direction by means of the tubulars racking device, to allow for placement of said drilling tubulars stand in said fingerboard device, wherein in said bypassing mode, the top drive unit is positioned in the retracted position and the tripping operation elevator is positioned in a retracted position in which the tripping operation elevator is away from the firing line and is retracted in a direction corresponding to the direction of retraction of the top drive unit, and wherein, in said bypassing mode, both the top drive unit and the tripping operation elevator are cleared from the firing line to such an extent that, with the tubulars racking device engaging on a drilling tubulars stand held by the slip device in the firing line above the well center, the top drive system is able to pass the location where the tubulars racking device engages on said drilling tubulars stand.

2. The drilling rig according to claim 1, wherein the top drive unit comprises a top drive frame supporting the top drive motor and the rotary output member, wherein the top drive frame is mobile mounted to the traveling carriage.

3. The drilling rig according to claim 2, wherein the top drive frame is supported on the carriage by a support arm, that is pivotally connected to the carriage and the top drive frame, and wherein the actuator system comprises one or more actuators between the traveling carriage and the support arm and one or more actuators between the traveling carriage and the top drive frame.

4. The drilling rig according to claim 2, wherein the tripping operation elevator is suspended by one or more links that are each connected at an upper end thereof to a pivotal elevator support arm that is pivotally connected to the traveling carriage about a horizontal pivot axis, and wherein the actuator system comprises one or more actuators between the top drive frame and the one or more links.

5. The drilling rig according to claim 3, wherein the tripping operation elevator is suspended by one or more links that are each connected at an upper end thereof to a pivotal elevator support arm that is pivotally connected to the traveling carriage about a horizontal pivot axis, and wherein the actuator system comprises one or more actuators between the top drive frame and the one or more links.

6. A method for tripping out a drilling tubulars string from a wellbore, wherein use is made of a drilling rig according to claim 1, comprising the following steps:

a. suspending a drilling tubulars string in the wellbore by means of the slip device;

b. bringing the top drive system in said tripping mode;

c. lowering the traveling carriage so that the tripping operation elevator reaches an initial engagement level and then connecting the tripping operation elevator with a top end of the suspended drilling tubulars string;

d. releasing the slip device and lifting the traveling carriage, so as to pull up a tubulars stand above the well center by means of the tripping operation elevator;

e. engaging the slip device to suspend the drilling tubulars string;

f. lowering the traveling carriage to as to move the tripping operation elevator to said initial engagement level for renewed pull up of a next tubulars stand, in which method at least one of the following steps is performed in time overlap with said lowering of the traveling carriage:

disconnecting the lifted tubulars stand from the suspended drilling tubulars string by means of a tubulars connection makeup and breaking device near the well center;

removing the disconnected tubulars stand from the firing line, primarily in a lateral direction, involving gripping the stand with the racking device; and placing the drilling tubulars stand in said fingerboard device; and g. when the tripping operation elevator has reached said initial engagement level, connecting the tripping operation elevator to the top end of the suspended drilling tubulars string, wherein during lowering of the carriage, the top drive system is temporarily brought into the bypassing mode to pass the location where the tubulars racking device engages on said drilling tubulars stand and after said passing is returned to the tripping mode.

7. A method for drilling a drilling tubulars string into a wellbore, wherein use is made of a drilling rig according to claim 1, comprising the following steps:

a. suspending a drilling tubulars string in the wellbore by means of the slip device with a drilling tubulars stand connected to the drilling tubulars string and extending above the well center;

b. bringing the top drive system in the wellbore drilling mode;

c. connecting the rotary torque output member to a top end of the drilling tubulars stand;

d. releasing the slip device and imparting a torque to the top end of the drilling tubulars stand;

e. drilling the drilling tubulars string into the wellbore until the top drive system comes in proximity of the drill floor;

f. engaging the slip device to suspend the drilling tubulars string;

g. disconnecting the rotary torque output member from the top end of the drilling tubulars string;

h. bringing the top drive system into the bypassing mode;

i. lifting the carriage;

in which method at least one of the following steps is performed in time overlap with said lifting of the carriage:

removing a drilling tubulars stand from the fingerboard device using the racking device;

placing the drilling tubulars stand in the firing line with the racking device; and connecting the tubulars stand to the suspended drilling tubulars string by means of a tubulars connection makeup and breaking device near the well center;

j. bringing the top drive system into the drilling mode; and k. connecting the top drive system to the top end of the drilling tubulars stand connected to the suspended drilling tubulars string.

8. The method according to claim 7, wherein the top drive system is brought into the bypassing mode during lifting of the carriage to pass the racking device.

9. The method according to claim 7, wherein the top drive system is first brought into the tripping mode before being brought to the bypassing mode and after passing the racking device is brought first into the tripping mode before being brought into the drilling mode.

10. The method according to claim 8, wherein the top drive system is first brought into the tripping mode before being brought to the bypassing mode and after passing the racking device is brought first into the tripping mode before being brought into the drilling mode.

* * * * *